US008245778B2

(12) United States Patent
Yeh et al.

(10) Patent No.: US 8,245,778 B2
(45) Date of Patent: Aug. 21, 2012

(54) FLUID CONTROL APPARATUS AND METHODS FOR PRODUCTION AND INJECTION WELLS

(75) Inventors: Charles S. Yeh, Spring, TX (US); Bruce A. Dale, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 12/670,079

(22) PCT Filed: Aug. 7, 2008

(86) PCT No.: PCT/US2008/072429

§ 371 (c)(1),
(2), (4) Date: Jan. 21, 2010

(87) PCT Pub. No.: WO2009/051881

PCT Pub. Date: Apr. 23, 2009

(65) Prior Publication Data

US 2010/0200233 A1 Aug. 12, 2010

Related U.S. Application Data

(60) Provisional application No. 60/999,106, filed on Oct. 16, 2007.

(51) Int. Cl.
*E21B 43/00* (2006.01)

(52) U.S. Cl. ..... 166/236; 166/276

(58) Field of Classification Search ..... 166/236, 166/276, 278

See application file for complete search history.

(56) References Cited

U.S. PATENT DOCUMENTS

| | | | |
|---|---|---|---|
| 1,620,412 | A | 3/1927 | Tweeddale |
| 4,064,938 | A | 12/1977 | Fast |
| 5,101,901 | A | 4/1992 | Shu et al. |
| 5,115,864 | A | 5/1992 | Gaidry et al. |
| 5,209,296 | A | 5/1993 | Donlon et al. |
| 5,211,235 | A | 5/1993 | Shu et al. |

(Continued)

FOREIGN PATENT DOCUMENTS

| | | |
|---|---|---|
| WO | WO 99/36667 | 7/1999 |

(Continued)

OTHER PUBLICATIONS

Bennett, C., et al., "Design Methodolgy for Selection of Horizontal Open-Hole Sand Control Completions Supported by Field Case Histories", SPE 65140, Oct. 24-25, 2000, pp. 1-19, 2000 SPE European Petroleum Conf., Paris, France.

(Continued)

*Primary Examiner* — William P Neuder
*Assistant Examiner* — Kipp Wallace
(74) *Attorney, Agent, or Firm* — ExxonMobil Upstream Research Company—Law Department

(57) ABSTRACT

Flow control systems and methods for use in injection wells and in the production of hydrocarbons utilize a particulate material disposed in an external flow area of a flow control chamber having an internal flow channel and an external flow area separated at least by a permeable region. The particulate material transitions from a first accumulated condition to a free or released condition when a triggering condition is satisfied without requiring user or operator intervention. The released particles accumulate without user or operator intervention, to control the flow of production fluids through a flow control chamber by at least substantially blocking the permeable region between the external flow area and the internal flow channel.

30 Claims, 8 Drawing Sheets

U.S. PATENT DOCUMENTS

| | | | | |
|---|---|---|---|---|
| 5,222,556 | A | 6/1993 | Donlon et al. | |
| 5,222,557 | A | 6/1993 | Shu et al. | |
| 5,355,949 | A | 10/1994 | Sparlin et al. | |
| 5,435,389 | A | 7/1995 | Shu et al. | |
| 5,476,143 | A | 12/1995 | Sparlin et al. | |
| 5,609,209 | A | 3/1997 | Shu | |
| 5,722,490 | A | 3/1998 | Ebinger | |
| 5,803,179 | A | 9/1998 | Echols et al. | |
| 5,881,809 | A | 3/1999 | Gillespie et al. | |
| 5,896,928 | A | 4/1999 | Coon | |
| 6,095,246 | A * | 8/2000 | Gray et al. | 166/285 |
| 6,109,350 | A | 8/2000 | Nguyen et al. | |
| 6,125,932 | A | 10/2000 | Hamid et al. | |
| 6,169,058 | B1 | 1/2001 | Le et al. | |
| 6,302,207 | B1 * | 10/2001 | Nguyen et al. | 166/276 |
| 6,516,885 | B1 | 2/2003 | Munday | |
| 6,619,397 | B2 | 9/2003 | Coon et al. | |
| 6,622,794 | B2 | 9/2003 | Zisk, Jr. | |
| 6,660,694 | B1 | 12/2003 | Taylor et al. | |
| 6,672,385 | B2 | 1/2004 | Kilaas et al. | |
| 6,767,869 | B2 | 7/2004 | DiLullo et al. | |
| 6,913,081 | B2 | 7/2005 | Powell et al. | |
| 6,935,432 | B2 | 8/2005 | Nguyen | |
| 7,258,166 | B2 | 8/2007 | Russell | |
| 7,318,472 | B2 * | 1/2008 | Smith | 166/276 |
| 7,517,586 | B2 * | 4/2009 | Fossum et al. | 428/402 |
| 7,708,068 | B2 * | 5/2010 | Hailey, Jr. | 166/278 |
| 7,789,152 | B2 * | 9/2010 | Langeslag | 166/296 |
| 7,913,765 | B2 * | 3/2011 | Crow et al. | 166/373 |
| 7,918,272 | B2 * | 4/2011 | Gaudette et al. | 166/205 |
| 2002/0020527 | A1 | 2/2002 | Kilaas et al. | |
| 2002/0189808 | A1 | 12/2002 | Nguyen et al. | |
| 2004/0060968 | A1 | 4/2004 | Takahashi et al. | |
| 2004/0106525 | A1 | 6/2004 | Willberg et al. | |
| 2004/0177957 | A1 | 9/2004 | Kalfayan et al. | |
| 2004/0261993 | A1 | 12/2004 | Nguyen | |
| 2005/0023003 | A1 * | 2/2005 | Echols et al. | 166/384 |
| 2006/0076150 | A1 | 4/2006 | Coronado et al. | |
| 2006/0175065 | A1 | 8/2006 | Ross | |
| 2006/0258546 | A1 | 11/2006 | Brannon et al. | |
| 2006/0272814 | A1 | 12/2006 | Broome et al. | |
| 2007/0039741 | A1 | 2/2007 | Hailey, Jr. | |
| 2007/0044962 | A1 | 3/2007 | Tibbles | |
| 2007/0044963 | A1 | 3/2007 | MacDougall | |
| 2007/0114020 | A1 | 5/2007 | Brekke | |
| 2008/0169099 | A1 * | 7/2008 | Pensgaard | 166/285 |

FOREIGN PATENT DOCUMENTS

| | | |
|---|---|---|
| WO | WO 99/54592 | 10/1999 |
| WO | WO 2004/094784 | 11/2004 |
| WO | WO 2005/061850 | 7/2005 |
| WO | WO 2007/024627 | 3/2007 |
| WO | WO 2007/092083 | 8/2007 |
| WO | WO 2007/094897 | 8/2007 |

OTHER PUBLICATIONS

Kaiser, T.M.V., et al., "Inflow Analysis and Optimization of Slotted Liners", SPE 80145, Nov. 6-8, 2000, pp. 200-209, SPE/Petroleum Society of CIM Int'l. Conf. on Horizontal Well Technology, Calgary, Canada.

Penberthy, Jr., W.L., et al., "Sand Control, Chpt. 4—Gravel-Pack Design", 1992, 8 pages, Henry L. Doherty Memorial Fund of AIME Society of Petroleum Engineers, Richardson, TX.

Seright, R.S., et al., "A Strategy for Attacking Excess Water Production", SPE 84966, May 15-16, 2001, pp. 158-169, 2001 SPE Permian Basil Oil and Gas Recovery Conf., Midland, TX.

Tang, Y., et al., "Performance of Horizontal Wells Completed with Slotted Liners and Perforations", SPE 65516, Nov. 6-8, 2000, pp. 1-15, 2000 SPE/Petroleum Society of CIM Int'l. Conf. on Horizontal Well Technology, Calgary, Canada.

Tiffin, D.L., et al., "New Criteria for Gravel and Screen Selection for Sand Control", SPE 39437, Feb. 18-19, 1998, pp. 201-214, 1998 SPE Formation Damage Control Conf., Lafayette, LA.

Wong, G.K., et al., "Design, Execution, and Evaluation of Frac and Pack (F&P) Treatments in Unconsolidated Sand Formations in the Gulf of Mexico", SPE 26563, Oct. 3-6, 1983, pp. 491-506, 68th Annual Technical Conf. & Exh. of the Society of Petroleum Engineers, Houston, TX.

*International Search Report*, dated Nov. 12, 2008, PCT/US2008/072429.

* cited by examiner

FLUID CONTROL APPARATUS AND METHODS FOR PRODUCTION AND INJECTION WELLS

CROSS REFERENCE TO RELATED APPLICATIONS

This application is the National Stage entry under 35 U.S.C. 371 of PCT/US2008/072429, that published as WO 2009/051881 and was filed 7 Aug. 2008, which claims the benefit of U.S. Provisional Application No. 60/999,106, filed 16 Oct. 2007, each of which is incorporated herein by reference, in its entirety, for all purposes.

FIELD

This invention relates generally to apparatus and methods for use in wellbores. More particularly, this invention relates to wellbore apparatus and methods for producing hydrocarbons and managing water production.

BACKGROUND

This section is intended to introduce the reader to various aspects of art, which may be associated with embodiments of the present invention. This discussion is believed to be helpful in providing the reader with information to facilitate a better understanding of particular techniques of the present invention. Accordingly, it should be understood that these statements are to be read in this light, and not necessarily as admissions of prior art.

The production of hydrocarbons, such as oil and gas, has been performed for numerous years. To produce these hydrocarbons, a production system may utilize various devices for specific tasks within a well. Typically, these devices are placed into a wellbore completed in either cased-hole or open-hole completion. In cased-hole completions, wellbore casing is placed in the wellbore and perforations are made through the casing into subterranean formations to provide a flow path for formation fluids, such as hydrocarbons, into the wellbore. Alternatively, in open-hole completions, a production string is positioned inside the wellbore without wellbore casing. The formation fluids flow through the annulus between the subsurface formation and the production string to enter the production string.

When producing hydrocarbons from subterranean formations, especially poorly consolidated formations or formations weakened by increasing downhole stress due to wellbore excavation and/or fluids withdrawal, it is possible to produce undesirable materials, such as solid materials (for example, sand) and fluids other than the desired hydrocarbons (for example, water). In some cases, formations may produce hydrocarbons without sand until the onset of water production from the formations. With the onset of water, these formations collapse or fail due to increased drag forces (water generally has higher viscosity than oil or gas) and/or dissolution of material holding sand grains together. Additionally or alternatively, water is often produced with hydrocarbon due to various causes including coning (rise of near-well hydrocarbon-water contact), casing leaks, poor cementing, high permeability streaks, natural fractures, and fingering from injection wells.

The sand/solids and water production can result in a number of problems. These problems include productivity loss, equipment damage, and/or increased treating, handling and disposal costs. For example, the sand/solids production may plug or restrict flow paths resulting in reduced productivity.

The sand/solids production may also cause severe erosion resulting in damage to wellbore equipment, which may create well control problems. When produced to the surface, the sand is removed from the flow stream and has to be disposed of properly, which increases the operating costs of the well.

Water production also reduces productivity. For instance, because water is heavier than hydrocarbon fluids, it takes more pressure to move it up and out of the well. That is, the more water produced, the less pressure available to move the hydrocarbons, such as oil. In addition, water is corrosive and may cause severe equipment damage if not properly treated. Similar to the sand, the water also has to be removed from the flow stream and disposed of properly. Any one or more of these consequences of water production increases the cost of operating the well.

The sand/solids and water production may be further compounded with wells that have a number of different completion intervals in which the formation strength may vary from interval to interval. Because the evaluation of formation strength is complicated, the ability to predict the timing of the onset of sand and/or water is limited. In many situations reservoirs are commingled to minimize investment risk and maximize economic benefit. In particular, wells having different intervals and marginal reserves may be commingled to reduce economic risk. One of the risks in these applications is that sand failure and/or water breakthrough in any one of the intervals threatens the remaining reserves in the other intervals of the completion.

Conventional methods for preventing or mitigating water production include selective perforation, zone isolation, inflow control system, resin treatment, downhole separation, and surface-controlled downhole valves. Preventive methods such as selective perforation, zone isolation, inflow control systems, and surface-controlled downhole valves are applied at pre-determined, high water production potential locations along the wellbore (or low potential in the case of selective perforation). Due to the uncertainty in identifying the timing, location and magnitude of potential water production, the results have been often unsatisfactory.

The historical water shut-off method is injecting chemicals into the water production intervals to plug the formation matrix. The chemicals include cement and resins, which are gelled or solidified with temperature and time. These methods have long been challenged by gelation kinetics, placement, and long-term stability. Other common methods include the use of packer or cement plugs to isolate water production zones. Mechanical sleeve or casing cladding has also been used to isolate the water inflow. The technique involves positioning either a thermally inflatable patch or a mechanically expandable patch against the desired cladding length. Good planning, design, and execution are required for job success.

Downhole separation methods rely upon the installation of a hydrocyclone and pump in the borehole to inject separated water to different subterranean horizons. The increasing completion complexity can be readily appreciated. To further complicate these efforts, the sizing of a suitable separator is difficult due to the changing incoming water rate during the well lifetime.

In recent efforts to address the problems presented by water production, polymers have been used to modify the permeability of the tubes and pipes associated with the production string. For example, some efforts include injecting polymers from the surface to target areas of water production and impede the water flow. The injected polymers have to be carefully selected and carefully injected for any chance of success in this implementation. Processes such as this requiring on-site intervention are generally more economically and technologically challenging.

As a variation on the efforts to use polymers to address water production, others have attempted to coat screens, such as conventional sand screens, with swellable materials designed to seal flow paths through swelling. These swellable materials are conventionally a polymeric material or other material coated with a polymer that reacts upon contact with water to swell. Past efforts have attempted to design screens having sufficient spacing to allow fluid flow under desired conditions and to form an adequate seal under undesired conditions. For example, the selection of the swellable materials and the choice of how much swellable material to incorporate in the screen required careful design to ensure the polymer or other material would react when desired and in the manner intended. Other efforts have disposed fixed swelling members in association with a conventional sand screen attempting to cause the swelling members to swell around the sand screen when water is produced. However, here again, the efforts have relied upon costly swellable materials that require careful selection. For example, when polymeric swelling materials are used, care must be taken to ensure that the polymer does not react with other chemicals that may be in the produced fluids, either to swell or in some other manner.

While typical sand and water control, remote control technologies, and interventions may be utilized, these approaches often drive the cost for marginal reserves beyond the economic limit. As such, a simple, lower cost alternative may be beneficial to lower the economic threshold for marginal reserves and to improve the economic return for certain larger reserve applications. Accordingly, the need exists for a well completion apparatus that provides a mechanism for managing the production of water within a wellbore, while staying within dimensional limitations of a wellbore.

Other related material may be found in at least U.S. Pat. No. 6,913,081; U.S. Pat. No. 6,767,869; U.S. Pat. No. 6,672,385; U.S. Pat. No. 6,660,694; U.S. Pat. No. 6,516,885; U.S. Pat. No. 6,109,350; U.S. Pat. No. 5,435,389; U.S. Pat. No. 5,209,296; U.S. Pat. No. 5,222,556; U.S. Pat. No. 5,222,557; U.S. Pat. No. 5,211,235; U.S. Pat. No. 5,101,901; and U.S. Patent Application Publication No. 2004/0177957. Additional related material may be found in U.S. Pat. No. 5,722,490; U.S. Pat. No. 6,125,932; U.S. Pat. No. 4,064,938; U.S. Pat. No. 5,355,949; U.S. Pat. No. 5,896,928; U.S. Pat. No. 6,622,794; U.S. Pat. No. 6,619,397; International Patent Publication WO/2007/094897; and International Patent Application No. PCT/US2004/01599. Further, additional information may also be found in Penberthy & Shaughnessy, SPE Monograph Series—"Sand Control", ISBN 1-55563-041-3 (2002); Bennett et al., "Design Methodology for Selection of Horizontal Open-Hole Sand Control Completions Supported by Field Case Histories," SPE 65140 (2000); Tiffin et al., "New Criteria for Gravel and Screen Selection for Sand Control," SPE 39437 (1998); Wong G. K. et al., "Design, Execution, and Evaluation of Frac and Pack (F&P) Treatments in Unconsolidated Sand Formations in the Gulf of Mexico," SPE 26563 (1993); T. M. V. Kaiser et al., "Inflow Analysis and Optimization of Slotted Liners," SPE 80145 (2002); Yula Tang et al., "Performance of Horizontal Wells Completed with Slotted Liners and Perforations," SPE 65516 (2000); and Graves, W. G., et. Al., "World Oil Mature Oil & Gas Wells Downhole Remediation Handbook," Gulf Publishing Company (2004).

SUMMARY

In some implementations of the present invention, systems for use with production of hydrocarbons include a first tubular member defining an internal flow channel. The first tubular member also at least partially defines an external flow area. The first tubular member further comprises a permeable region providing fluid communication between the external flow area and the internal flow channel. A particulate composition is disposed in the external flow area and comprises a plurality of particles bound by a reactive binding material. The binding material is adapted to release particles in response to a triggering condition, such as the presence of water in the production fluids. Once released, the particles move within the external flow area and are at least substantially retained in the external flow area to form a particulate accumulation. The particulate accumulation forms in the external flow area to block the permeable region of the first tubular member.

In some implementations, the present systems include a first tubular member and an exterior member that cooperate to at least partially define an external flow area. The first tubular member also defines an internal flow channel and comprises a permeable region providing fluid communication with the internal flow channel. The exterior member also comprises a permeable region. The permeable region of the exterior member provides an inlet to the external flow area creating a flow path between the inlet of the exterior member and the permeable region of the first tubular member. A particulate composition is disposed in the external flow area at least partially in the flow path. The particulate composition comprises a plurality of particles bound by a reactive binding material adapted to release particles in response to a triggering condition. After being released from the particulate composition, at least some of the released particles accumulate to form a particulate accumulation blocking the permeable region of the first tubular member.

Systems within the scope of the present invention may also be described as including a production string and at least one flow control chamber. The production string includes a production tube having an internal flow channel adapted to receive fluids when in a wellbore environment in a formation. The at least one flow control chamber is defined in the production string and may include a changed-path flow control chamber. The changed-path flow control chamber comprises offset inner and outer permeable regions configured to define a flow path between the outer permeable region and the inner permeable region. Flow control chambers that are not changed-path flow control chambers also include inner and outer permeable regions but the permeable regions are not offset. A consolidated particulate pack is disposed at least partially in the flow path between the inner and the outer permeable regions. The consolidated particulate pack comprises a plurality of particles held together by a binding agent. The binding agent is selected to release particles in response to a triggering condition. The particles released from the consolidated particulate pack are dimensioned to be at least substantially retained by the inner permeable region. The retained particles may accumulate adjacent to the inner permeable region to block the inner permeable region preventing fluids from entering the internal flow channel.

The present invention also includes methods for control flow of production fluids from a wellbore. Exemplary methods include providing a production string including a production tube having an internal flow channel adapted to receive fluids when in a wellbore environment. At least one external flow area is defined in association with the production tube and is separated from the internal flow channel by an inner permeable region. A consolidated particulate pack comprising a plurality of particles is provided. The particles of the particulate pack are held together by a binding agent selected to release particles in response to a triggering condition. The consolidated particulate pack is disposed in the external flow area. The particles of the consolidated particulate pack are dimensioned to accumulate adjacent to the inner permeable region and to prevent fluids from entering the internal flow channel.

BRIEF DESCRIPTION OF THE DRAWINGS

The foregoing and other advantages of the present technique may become apparent upon reading the following detailed description and upon reference to the drawings in which.

DETAILED DESCRIPTION

Figure 1:
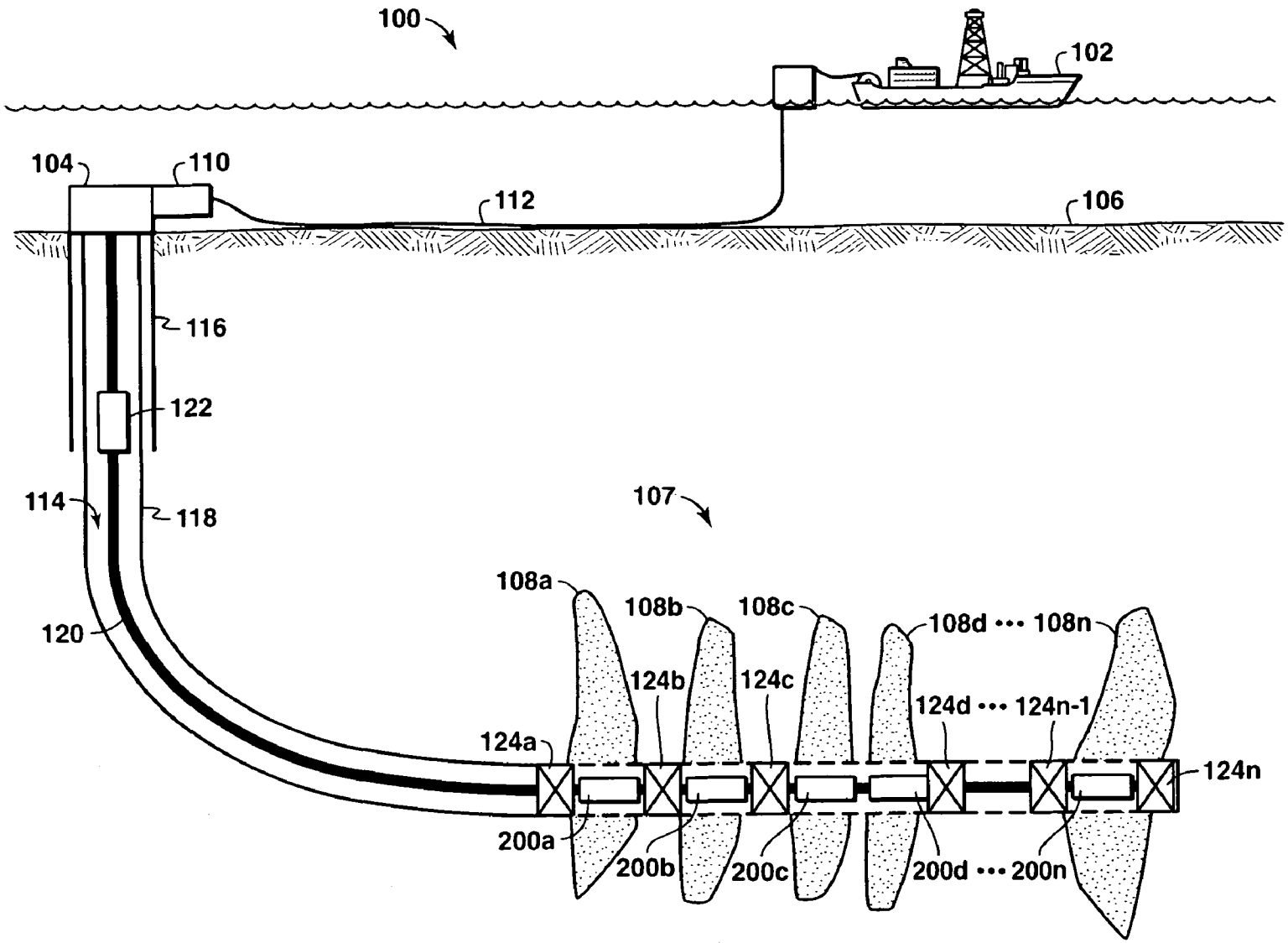
FIG. 1 is an exemplary production system in accordance with certain aspects of the present disclosure.

In the following detailed description, specific aspects and features of the present invention are described in connection with several embodiments. However, to the extent that the following description is specific to a particular embodiment or a particular use of the present techniques, it is intended to be illustrative only and merely provides a concise description of exemplary embodiments. Moreover, in the event that a particular aspect or feature is described in connection with a particular embodiment, such aspects and features may be found and/or implemented with other embodiments of the present invention where appropriate. Accordingly, the invention is not limited to the specific embodiments described below, but rather; the invention includes all alternatives, modifications, and equivalents falling within the scope of the appended claims.

The present disclosure relates to systems and methods to control fluid flow through production tubes to enhance and/or facilitate the production of hydrocarbons from producing wells. In accordance with the present disclosure, a consolidated particulate pack is combined with a flow control chamber to provide a fluid control system capable of limiting or preventing the flow of undesired fluids into the production tube without requiring monitoring or intervention by operators. References herein to fluids to be controlled by the present systems and methods include liquid and gaseous fluids. The presence of water in the production fluid is referred to frequently herein as a triggering condition. In such references, the nomenclature water is intended to refer to aqueous fluids generally and includes any production fluids in which water is present. As discussed more fully below, the particulate packs of the present disclosure may be configured to respond under different triggering conditions, such as greater or lesser concentrations of water in the production fluids.

While the present disclosure refers primarily to production strings and production operations, the principles and teachings of the present disclosure, and therefore the scope of the claims, encompasses application of the present technologies to injection wells and injection operations. In injection operations, for example, certain injection profiles to the reservoir are desired for efficient accomplishment of the injection objectives, such as water flooding, matrix acidizing, etc. However, using water flooding as an example, the injected water often takes the path of least resistance through the formation after leaving the injection string. Depending on the formation and the reservoir, the path of least resistance may not coincide with the desired injection profile. For example, the water from the water flood is typically intended to flow through areas of low permeability to flood or push the oil toward a producing well. However, if there are areas of higher permeability, such as areas of naturally high permeability, natural fractures, induced fractures, wormholes, etc., the water will naturally flow in that direction, reducing the treatment efficiency and possibly resulting in early water breakthrough in the production wells. Similarly, injection operations for stimulation, such as matrix acidizing, may have targeted areas for the application of the acid and the acid may have natural affinity for particular formation features, which may not always be the same. Utilizing the technologies, systems, and methods described herein, segments of the injection string may be selectively closed, or at least substantially blocked, to restrict the flow of fluids through that segment. While the fluids may still contact the formation adjacent the blocked segment, it only does so after overcoming the friction in the annulus from the desired target zone to the 'thief zone.'

As will be seen in the discussion below, the systems and methods of the present disclosure may be adapted to provide unrestricted flow followed by a restricted flow after a triggering condition is met. The triggering condition may be naturally occurring, such as water production from the formation, or may be operator imposed. For example, a triggering fluid may be strategically injected in an injection operation to adjust the injection profile. Still further, the restricted flow profile can be reversed in some implementations. The reversal, whether in injection operations or production operations, may utilize an injected fluid or a natural produced fluid. While water is a fluid that may be used as a triggering fluid, other fluids, including liquids and gases, may be selected as the triggering fluid. The selection of particles for the particulate pack, the selection of binding materials, and the selection of triggering fluids may each be influenced by the reservoir, the formation, and the planned operations. While the description below refers primarily to water-based triggering fluids and water control in production operations, the consolidated particle packs may be used in a variety of configurations and implementations.

The consolidated particulate pack is disposed in the flow control chamber and is configured to release particles from the pack in response to predetermined condition(s), such as contact with water or other undesired fluid(s). For example, the consolidated particulate pack may include binding agents selected to dissolve in water (or under other conditions) to release the bound particles. The released particles are then transported in flow paths in the flow control chamber and accumulate in the flow control chamber in a manner to hinder, limit, or at least substantially prevent fluid flow through the flow control chamber. Implementation of the present systems and methods may allow produced fluids to enter the production tubing string in certain production intervals while limiting such flow in other production intervals. For example, the present systems and methods utilize compartments or chambers in the production string, such as in tool sections or pipes connected to production tubing, to create localized particulate accumulations when water is produced.

Turning now to the drawings, and referring initially to FIG. 1, an exemplary production system 100 in accordance with certain aspects of the present techniques is illustrated. In the exemplary production system 100, a floating production facility 102 is coupled to a subsea tree 104 located on the sea floor 106. However, it should be noted that the production system 100 is illustrated for exemplary purposes and the present techniques may be useful in the production or injection of fluids from any subsea, platform, or land location. Accordingly, the production system may include a floating production facility 102, as illustrated, or any other suitable production facilities.

The floating production facility 102 is configured to monitor and produce hydrocarbons from one or more subsurface formations, such as subsurface formation 107, which may include multiple production intervals or zones 108*a*-108*n*, wherein number "n" is any integer number, having hydrocarbons, such as oil and gas. To access the production intervals 108*a*-108*n*, the floating production facility 102 is coupled to a subsea tree 104 and control valve 110 via a control umbilical 112. The control umbilical 112 may be operatively connected to production tubing for providing hydrocarbons from the subsea tree 104 to the floating production facility 102, control tubing for hydraulic or electrical devices, and a control cable for communicating with other devices within the wellbore 114.

To access the production intervals 108*a*-108*n*, the wellbore 114 penetrates the sea floor 106 to a depth that interfaces with the production interval 108*a*-108*n*. The wellbore may be drilled horizontally, vertically, or at any variety of directions, as indicated by the directionally drilled wellbore of FIG. 1. As may be appreciated, the production intervals 108*a*-108*n*, which may be referred to as production intervals 108, may include various layers or regions of rock that may or may not include hydrocarbons and may be referred to as zones. As described initially above, the tree 104, which is positioned over the wellbore 114 at the sea floor 106, provides an interface between devices within the wellbore 114 and the production facility 102. Accordingly, the tree 104 can be coupled to a production string 120 to provide fluid flow paths between the production intervals 108 and the control umbilical 112 and any other tubes, pipes, lines, or other apparatus disposed outside of the wellbore for the purpose of collecting or handling the produced fluids and/or controlling and/or monitoring the operations.

Within the wellbore 114, the production system 100 may include additional equipment to provide access to the production intervals 108*a*-108*n*. For instance, a surface casing string 116 may be installed from the sea floor 106 to a location at a specific depth beneath the sea floor 106. Within the surface casing string 116, an intermediate or production casing string 118, which may extend down to a depth near the production interval 108, may be utilized to provide support for walls of the wellbore 114. The surface and production casing strings 116 and 118 may be cemented into a fixed position within the wellbore 114 to further stabilize the wellbore 114. Within the surface and production casing strings 116 and 118, a production tubing string 120 may be utilized to provide a flow path through the wellbore 114 for hydrocarbons and other fluids. Production tubing string 120 refers to the collection of pipes and pipe sections extending from the sea floor into the wellbore. Accordingly, the production tubing string includes conventional production tubing as well as tool sections and other tubular members that couple to the production tubing along the length of the wellbore.

Along the length of the production tubing string, a subsurface safety valve 122 may be utilized to block the flow of fluids from the production tubing string 120 in the event of rupture, break, or other unexpected events above or below the subsurface safety valve 122. Further, packers 124*a*-124*n* may be utilized to isolate specific zones within the wellbore annulus from each other. The packers 124*a*-124*n* may include external casing packers, such as the SwellPacker™ (Halliburton), the MPas® Packer (Baker Oil Tools), or any other suitable packer for an open or cased wellbore, as appropriate.

In addition to the above equipment, other devices or tools, such as flow control systems 200*a*-200*n*, may be utilized to manage the flow of fluids and/or particles into the production tubing string 120. The flow control systems 200*a*-200*n*, which may herein be referred to as flow control system(s) 200, may include pre-drilled liners, slotted liners, stand-alone screens (SAS), pre-packed screens, wire-wrapped screens, membrane screens, expandable screens and/or wire-mesh screens. The flow control systems 200 are described further herein in connection with other Figures. The flow control systems 200 may manage the flow of hydrocarbons and other fluids and particles from the production intervals 108 to the production tubing string 120.

As noted above, many wells have a number of completion intervals and the hydrocarbon/water contact relationship as well as the sanding tendency may vary from interval to interval and over time within a single interval. The current ability to predict the timing and location of the onset of sand and/or water is limited. In many wells, commingling of production intervals 108*a*-108*n* may be preferred to simplify well completion and well production and to maximize economic benefit, which is particularly true for deep water wells, wells in remote areas, and/or for the capture of marginal reserves. A major risk in these applications is that sand failure and/or water breakthrough in any one interval threatens the hydrocarbon production efforts as well as any remaining reserves recovery.

To address these concerns, various sand and water control methods are commonly used. For instance, typical sand control methods include stand-alone screens (also known as natural sand packs), gravel packs, frac packs and expandable screens. These methods limit sand production but are not designed to limit or prevent a particular fluid production (i.e., fluid control is the same regardless of what type of fluid is being produced, whether hydrocarbon, water, or otherwise). Furthermore, typical mechanical water control methods include cement squeezes, bridge plugs, straddle packer assemblies, and/or expandable tubulars and patches. In addition, some other wells may include chemical isolation methods, such as selective stimulation, relative permeability modifiers, gel treatments, and/or resin treatments. These methods require well interventions and the results have not been consistent due to complexity in predicting the timing, location, and mechanism of water production during the well lifetime.

In certain environments, such as deep water wells, high-pressure, high temperature wells, and wells in remote regions, well intervention is often expensive, risky, and sometimes not even possible.

Despite the variety of methods utilized, available technology for controlling water production is generally complex and expensive. Indeed, the high cost and complexity of conventional flow control, remote control technologies, and intervention costs that are utilized to manage water and/or sand problems often drive costs for marginal projects beyond the economic limit for a given well or field. Uncontrollable water production in a well may result in loss of hydrocarbon production and/or require drilling new wells in the region. A simple, lower cost alternative is still needed to lower the economic threshold for marginal reserves and to enhance the economic return for other wells and fields. Exemplary flow control systems 200 are shown in greater detail in FIGS. 2-13 below.

Figure 2C:
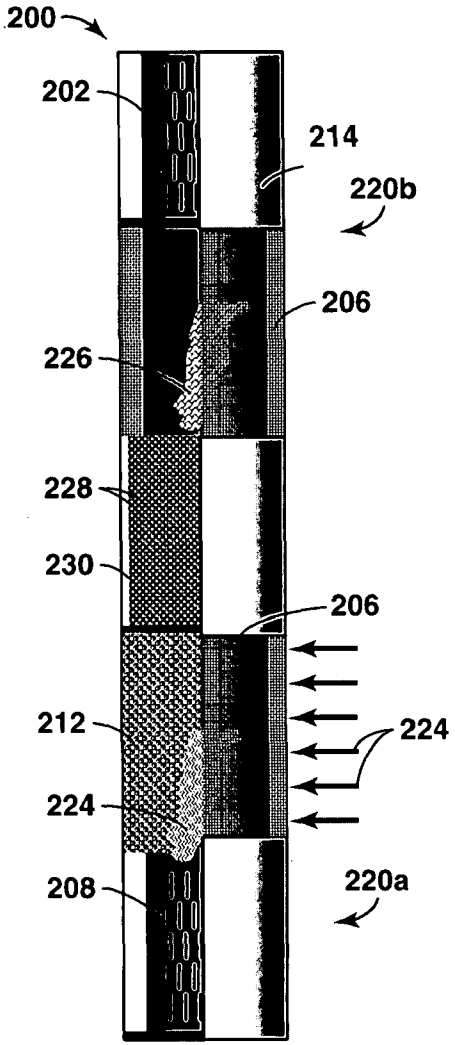
FIGS. 2A-2C are schematic side views, including partial cutaway views, of a water control system.
Figure 2B:
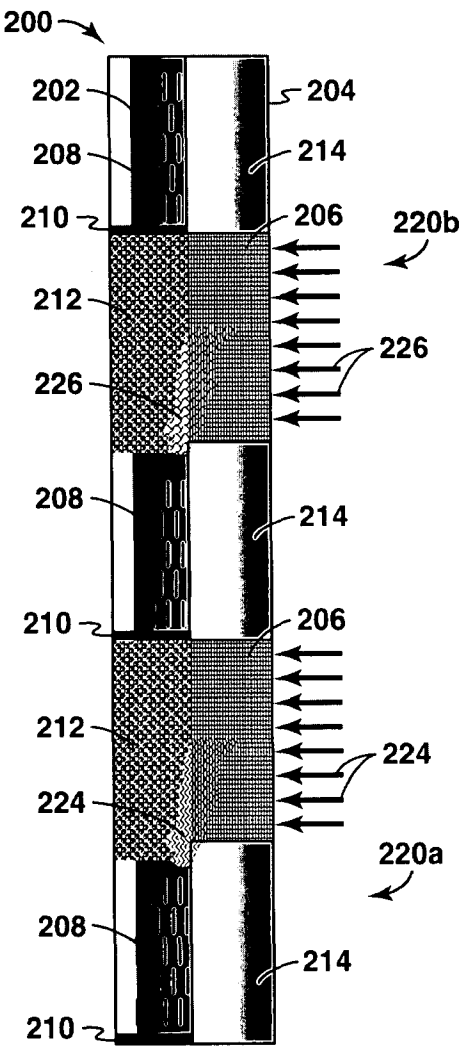
Figure 2A:
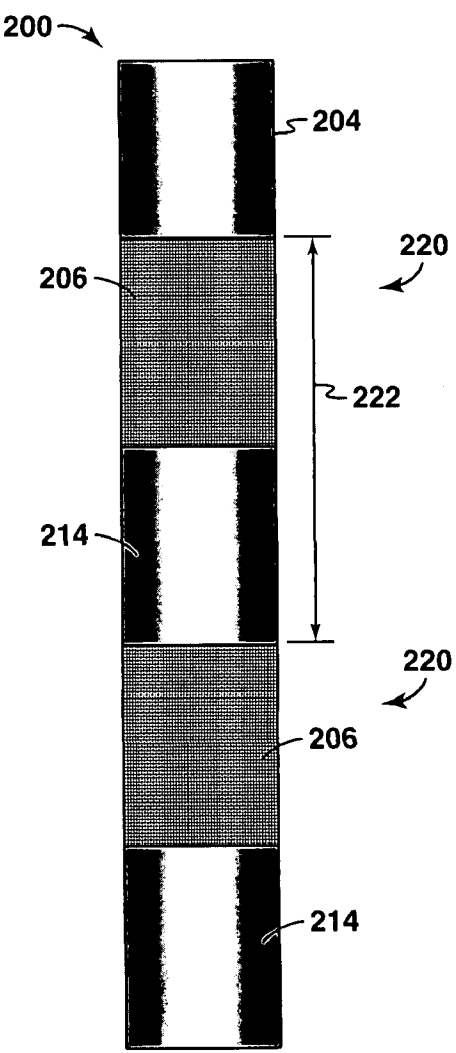

FIGS. 2A-2C are schematic views of an exemplary flow control system 200 according to the present disclosure. In FIGS. 2A-2C a representative embodiment of various components of the flow control system 200 is shown, including such components as a base pipe 202, an outer jacket 204, an outer permeable region 206, an inner permeable region 208, chamber isolators 210, and particulate packs 212. These components are utilized to manage the flow of water and particles into the production tubing string 120, and more particularly to manage the flow of water into the base pipe 202.

With reference to FIGS. 2A-2C, the general construction of an exemplary embodiment of a flow control system 200 is shown. FIG. 2A illustrates a side view of a representative flow control system 200 showing an outer jacket 204 having an outer impermeable region 214 and an outer permeable region 206. The outer jacket 204 may be made of any suitable materials and in any suitable manner of construction. Exemplary methods and materials may be found in the teachings of conventional sand control systems, such as wire-wrapped screens and coating materials. While FIG. 2A illustrates an outer jacket 204 having outer permeable regions 206 and outer impermeable regions 214, suitable flow control systems 200 may be constructed without outer impermeable regions 214.

The outer permeable region 206 may be made permeable to hydrocarbons and other fluids through any suitable methods such as the provisions of slits, perforations, spaces between wrapped wire, etc. In some embodiments, the outer permeable region 206 may be configured to at least partially block sand and other particulate material from the production intervals 108 and/or the subsurface formation 107, which particulate material from the production intervals 108 and the subsurface formation 107 is referred to herein as formation particulates (as opposed to particulate material that is a component of the flow control system, as discussed below).

FIG. 2A, in combination with FIGS. 2B and 2C, further illustrates that the representative flow control system 200 includes a plurality of flow control chambers 220, having a chamber length 222 defined by the longitudinal space between chamber isolators 210. As illustrated, the outer permeable region 206 is longitudinally offset from the inner permeable region 208 such that the outer permeable region 206 and the inner permeable region 208 do not overlap. In such implementations, the chamber length 222 may be determined by the sum of the lengths of the inner and outer permeable regions 206, 208, and may be still longer. The size of the outer and inner permeable regions 206, 208 may vary depending on the conditions of the well, such as the length of the production interval 108, the expected stability of the subsurface formation, the expected water content of the reservoir and/or surrounding area, the expected longevity of the well, etc. For example, shorter chamber lengths may be preferred in implementations for shorter intervals to provide tight control over the interval. Similarly, longer chamber lengths may be preferred for implementations in longer intervals to provide suitable control over the length of the interval. The preferred level of fluid control in a particular interval may be determined by the characteristics of the interval itself and/or may be determined by the local experience of the well operators. Similarly, while the flow control chambers are illustrated as being in continuing succession from one to the next, some implementations of the flow control systems herein may dispose flow control systems along the length of the production string with otherwise conventional production tubing separating the flow control systems. Such an implementation is shown schematically in FIG. 1.

While flow control systems of the present invention may vary in the size of the permeable regions, the size of the flow control chambers, the relationship between flow control chambers, the location of flow control chambers within the wellbore, and other specifics, the principles of the present disclosure that provide the flow control features persist across the various embodiments described, suggested, and/or alluded to herein. At least some of these principles are illustrated in FIGS. 2B and 2C, which provide schematic side views of the representative flow control system of FIG. 2A including partial cutaway views to illustrate elements of the operation of the flow control system 200.

FIG. 2B illustrates via the partial cutaway schematic that the flow control system 200 can include multiple flow control chambers 220, such as the two and one half chambers shown. Additionally, FIG. 2B illustrates that within the outer jacket 204 and outside the base pipe 202 lies a consolidated particulate pack 212, which may also be referred to as a particulate composition 212. Accordingly, the particulate composition 212 is disposed in an external flow area (best seen in FIGS. 3-5). As illustrated in FIG. 2B, the particulate composition 212 initially is disposed in association with the outer permeable region 206 underlying the outer permeable region 206 and not overlapping the inner permeable region 208. FIG. 2B illustrates in the two distinct flow control chambers 220*a* and 220*b* two different flow scenarios that may be encountered during production. In flow control chamber 220*a*, fluids consisting primarily, if not entirely, of hydrocarbons (hydrocarbon-rich fluid 224) are illustrated as entering through the outer permeable region 206 and passing through and/or around the particulate composition 212. In contrast, flow control chamber 220*b* is experiencing an inflow of fluids containing water (water-rich fluid 226). As it is rare that fluids from a production interval will be exclusively hydrocarbon or exclusively water, the distinction between hydrocarbon-rich fluid 224 and water-rich fluid 226 may be quite fine, and may be defined by the operator of the wellbore according to the principles described herein.

With reference to FIG. 2C and with continuing reference to FIG. 2B, it can be seen that the particulate composition 212 responds differently to the different fluids 224, 226. FIG. 2C illustrates that the hydrocarbon-rich fluid 224 continues to flow through the particulate composition 212 in flow control chamber 220*a*. FIG. 2C further illustrates that flow control chamber 220*b* has responded to the inflow of water-rich fluid 226 and has effectively closed the inner permeable region 208 of the flow control chamber. In summary, the particulate composition 212 of flow control chamber 220*b* has responded by releasing the particles of the particulate composition allowing them to flow with the incoming fluids to the inner permeable region 208, where the released particles 228 are retained by the inner permeable region 208 to form a particulate accumulation 230. The particulate accumulation 230 closes, or at least substantially closes, the inner permeable region 208, which hinders, limits, prevents, or at least substantially prevents water-rich fluid 226 from entering the base pipe 202. Accordingly, the flow control chamber 220*b* acts to control water production from production intervals. Because water production often brings with it sand production, the closure of flow control chamber 220*b* will also help reduce sand production. Produced fluids 226 that would have otherwise entered the base pipe in flow control chamber 220*b* may proceed outside of the outer jacket 204, such as within the production interval 108, and attempt to enter through flow control chamber 220*a*. As the fluids entering flow control chamber 220*a* are contaminated by undesired fluids 226, it too can respond to the undesired fluids by releasing particles to close the flow control chamber 220*a*.

Figure 7:
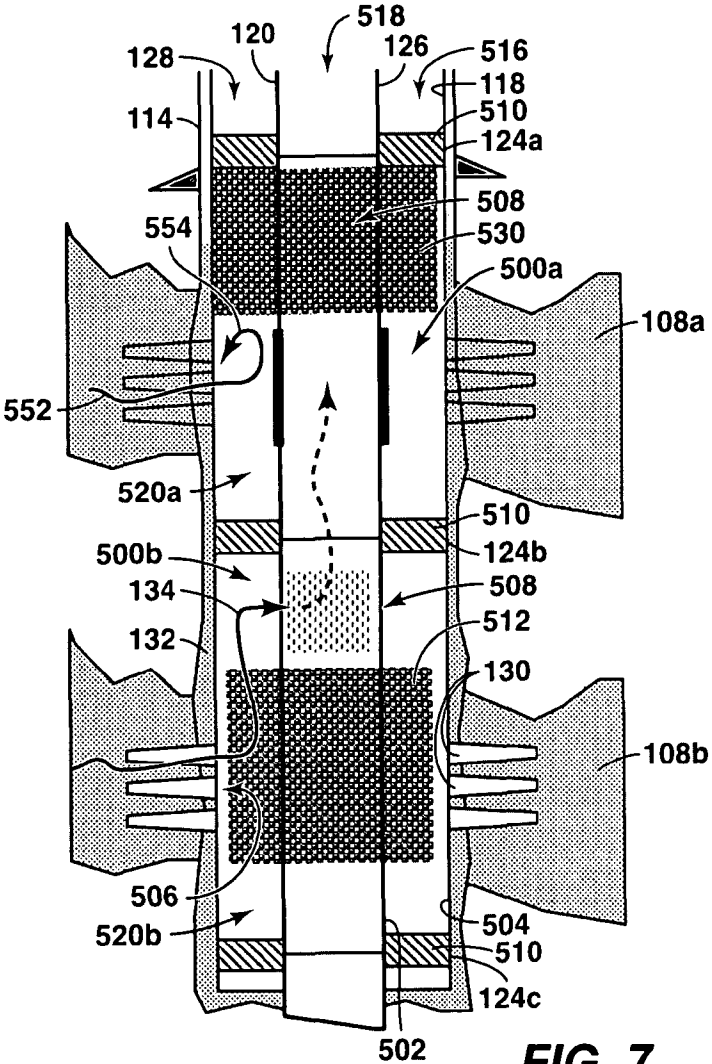
FIG. 7 is a schematic side view of water control systems disposed within a producing wellbore.
Figure 11:
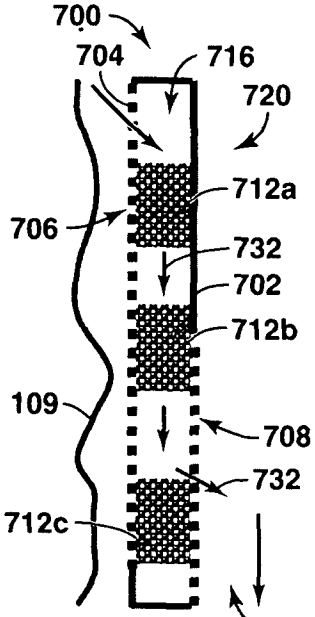
FIG. 11 is a schematic view of a portion of a water control system.
Figure 9:
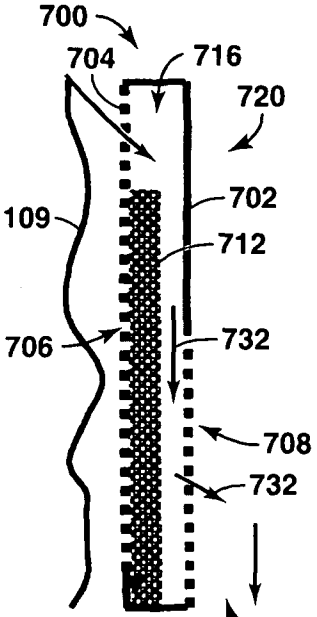
FIG. 9 is a schematic view of a portion of a water control system.
Figure 12:
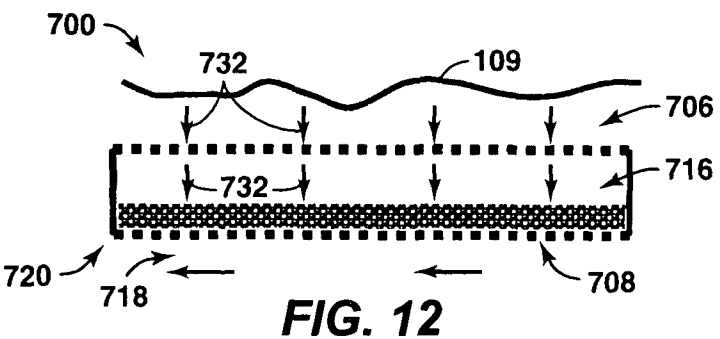
FIG. 12 is a schematic view of a portion of a water control system.

With FIGS. 2A-2C providing a representative embodiment and illustrating several principles and features of the present flow control systems 200, many variations on the specific embodiment shown can be appreciated. For example, FIGS. 2A-2C illustrate a flow control system 200 utilizing a base pipe 202 and an outer jacket 204 where the outer jacket was illustrated and described after the manner of production tubing strings incorporating sand control features such as outer and inner screens. However, outer jacket 204 need not be associated with the production tubing string 120 and may be provided by the production casing string 118 where the outer permeable region 206 is provided by the perforations in the casing. Such an implementation is schematically illustrated in FIG. 7 and will be further described in connection therewith below. Additionally or alternatively, the flow control systems 200 within the present invention may include inner and outer permeable regions 208, 206 that are not longitudinally offset one from the other as illustrated in FIGS. 2A-2C. For example, there may be partial or complete overlap of the two permeable regions, as shown in FIGS. 9, 11, and 12 and described in connection therewith.

The flow control systems 200 presented herein provide a base pipe 202, or other production tube designed to carry the desired production fluids, having discrete permeable regions that allow fluids to enter the internal flow channel of the base pipe 202. The base pipe 202 at least partially defines an external flow area in which is disposed a particulate composition 212 adapted to release particles when exposed to certain triggering conditions, such as water. The released particles then flow within the external flow area and accumulate at the permeable regions to hinder, block, or otherwise limit or prevent the flow of fluids into the base pipe internal flow channel, or to otherwise form a particulate plug to completely or at least substantially block the flow of fluids into the base pipe. Some implementations may include elements to further define flow control chambers 220 allowing more refined control of fluid flow and/or to facilitate the accumulation of released particles in desired regions within the external flow area, such as illustrated and discussed more clearly in connection with FIGS. 5A-5F.

The consolidated particulate pack 212 may be configured in any suitable manner to be disposed within the external flow area as described above. At least some suitable configurations will become apparent from the descriptions and figures provided herein; others are also within the scope of the present invention. The particulate pack or particulate composition 212 may be formed by consolidating or cementing any suitable particles together in the desired manner. In some implementations, the binding or cementing agent may be based on alkali metal silicates. Exemplary alkali metal silicates may be single-phase fluids adapted to cure into cementing material at elevated temperatures. For example, potassium silicate and urea, potassium silicate and formamide, or ethylpolysilicate, HCl, and ethanol can be combined to provide an acceptable binding agent. Other suitable binding materials may be used including other alkali metal silicates and other materials.

Alkali metal silicates may be suitable binding agents when the triggering fluid (or fluid that triggers the release of particles) is water. That is, when the flow control systems 200 are configured to control fluid flows from the production intervals to limit water production, the binding agents may be selected to respond to the presence of water, such as described in connection with FIGS. 2B and 2C. Flow control systems 200 may similarly be configured to respond to the presence of other fluids or materials in the fluids from the production interval 108. For example, binding agents may be selected to respond to the presence of natural gas causing flow control chambers 220 to close or seal when natural gas is produced or when natural gas is produced in quantities or rates greater than an acceptable level. Such a configuration may allow operators to control the gas production, thereby controlling the natural drive pressure in the reservoir. Similarly, the binding agents may be selected for sensitivity to other chemicals or materials in the produced fluids, such as the presence of hydrogen sulfide, that are preferably not drawn through the base pipe.

It should be noted that different flow control chambers along the same production tubing string may be configured to respond to different triggering fluids based on the estimates or knowledge of the conditions in the relevant production intervals 108, such as whether the production interval is gas-rich or water-rich. Regardless of the triggering condition for which the flow control chamber and/or system is designed, the binding agents selected to consolidate the particles are preferably selected to be compatible with the remainder of the wellbore operations, such as not being harmful to the equipment or unreasonably difficult to separate from the produced fluids.

With continuing reference to the binding agents or cementing materials used to form the particulate pack 212, the type of agent used and its strength and material properties may be selected to control the rate of dissolution of the cementing material, or the rate at which the particles are released when the wellbore is in production mode. For example, the binding agents, and the particulate composition generally, may be adapted to retain the particles if the water concentration in the produced fluids is below a predetermined threshold. Alternatively, the binding agents may be selected to respond to elements such as time, temperatures, concentrations of triggering fluids, flow rates of the produced fluids, etc. Moreover, the configuration of the particulate pack 212 itself, including the thickness and porosity or permeability of the particulate pack, may affect the dissolution rate and therefore the rate at which the particles are released. Each production interval and/or wellbore operator may have different tolerances with respect to any one or more wellbore condition. The present systems and methods allow an operator to control the fluid flow in discrete sections of the wellbore based on one or more of these conditions while not disturbing the flow in other sections of the wellbore.

Particles suitable for use in the particulate composition 212 can include gravel, sand, carbonate, silts, clays, or other particulate materials, such as particles made of polymers or other materials. For cost and compatibility reasons, natural materials such as gravel and sand may be preferred particles for use in preparing the particulate packs 212. However, other factors such as controllability of particle size and packing density and/or impact on the wellbore's production and/or equipment may encourage use of other particulate materials. Moreover, particles of different materials may be combined in a particulate pack depending on the desired properties of the particulate pack and/or the resulting particulate accumulation.

The particles selected for incorporation in the particulate pack 212 may be of consistent or varied sizes and dimensions. In general, it may be preferred to include particles sized larger than the slits or perforations of the inner permeable region 208 such that the particles, or at least a majority of the particles, are retained in the external flow area and not allowed to enter the internal flow channel of the base pipe 202. Accordingly, the configuration of the base pipe 202, and particularly the configuration of the inner permeable region 208, and the selection of the particles may be related.

As suggested by the foregoing description, the resulting particulate accumulation has low permeability and resists flow through the inner permeable region 208. The permeability of the particulate accumulation 230 may depend on the particulate materials, density, shape, size, variety, etc. Incorporation of particles of varied sizes into the particulate pack 212 may be accomplished by mixing differently sized particles of the same material or by mixing different materials. For example, sand and gravel may be incorporated into the particulate pack 212 to provide a diversity of particle sizes. Other mixtures and compositions of particle material types may be used. In some implementations, particles may include materials that undergo change when exposed to the triggering condition. For example, polymers may be used that swell upon contact with aqueous fluids (or under other triggering conditions). In such implementations, a relatively small particulate pack may be used to form a larger particulate accumulation as a result of the swelling particles. The swelling may also promote improved blockage of the inner permeable region. Any variety of materials may be used to provide this swelling, some examples of which were described above.

Particle size ranges from submicron to a few centimeters may provide a diversity of particle sizes to increase the packing density of the accumulation 230, thereby reducing the permeability. Exemplary particle sizes may range from about 0.0001 mm to about 100 mm. Considering particle size distribution and the inner permeable region 208, the particles of the particulate pack 212 may be selected to provide that at least 10% (by volume) of the particles are larger than the openings of the inner permeable region 208. More preferably, a greater proportion of the particles will be larger than the openings of the inner permeable region. A smaller proportion may also be preferred in some circumstances. In other situations, the particles selected for the particulate pack 212 may have a diversity of sizes resulting in a uniformity coefficient greater than about 5. The uniformity coefficient is a measure of particle sorting and is defined to be d40/d90, as is conventional in oilfield particle size measurements. As is conventional, d40 indicates that 40% of the total particles are coarser than the d40 particle size; similarly, d90 indicates that 90% of the total particles are coarser than the d90 particle size. The particle sizes may be measured by use of any suitable measurement apparatus. For example, sieving may be used to measure particle sizes in the range of 0.037 mm to about 8 mm and laser diffraction may be used to measure particle sizes in the range of about 0.0001 mm to about 2 mm (e.g., Malvern's Mastersizer® 2000 may be used). Other systems and apparatus may be used to measure particles outside of these ranges.

Factors other than (or in addition to) size may impact the packing density and/or permeability of the resulting particulate accumulation 230. For example, particle shapes and configurations may impact the particles' ability to pack tightly in the particulate accumulation 230. Particle shapes are not easily controlled when working with natural materials such as sand and gravel, but if polymer-based materials or other man-made materials are used in the particulate pack 212 the particles may be custom shaped to promote packing density. Additionally, the density of the particles may affect the ability of the particles to move through the external flow area and to pack into the particulate accumulation 230, as may the orientation of the wellbore. The particles may be selected to have a volume and density appropriate for the particle size distribution desired to promote sufficiently high packing density and sufficiently low permeability.

In some implementations of the present technology, methods may be implemented to determine or design a preferred particulate composition 212. As one exemplary method, particles if differing sizes and/or configurations may be selected and mixed based on a predicted, estimated, and/or calculated accumulation profile under expected wellbore conditions. The selected and mixed particles may then be measured to determine the size distribution and/or uniformity coefficient, which step may not be necessary if the particle selection process is sufficiently controlled. The particles are then released into a prototype flow control chamber or a mock-up version of a flow control chamber run under expected wellbore conditions. The particulate accumulation is then allowed to form and its permeability is measured. If the permeability is sufficiently low, the particle selection mix may be determined to be suitable for wellbore applications similar to those tested. If the permeability is too high, the methods may be repeated until a suitable particle size and configuration mix is identified. In some implementations, the particulate mixture may result in some particulates being produced through the inner permeable region 208 before the particulate accumulation is sufficiently formed to block the flow. The amount of particulate production may be controlled to any desired level by adjusting the particle size, shape, mixture, etc., as well as by changing the size of the openings in inner permeable region 208.

Continuing with the discussion of the composition of the particulate pack, an exemplary particulate pack may include particles of different sizes wherein the different sizes are of different materials. Using particles of different materials or compositions may enable the flow control chambers to provide a reversible particulate accumulation to selectively block and subsequently allow flow through the inner permeable region. For example, it may be desirable to provide a flow control chamber that blocks the flow of production fluids through the chamber when the production fluids includes more than a predetermined concentration of gas. Accordingly, the particulate pack may be adapted to release the mixed-size, mixed-composition particles when the production fluid meets the predetermined condition. The use of larger and smaller particles enables the smaller particles to effectively seal the inner permeable region against gas flow. However, it may be desirable at some later time to allow the gas to flow through the chamber. As one exemplary scenario, it may be desirable to limit the gas flow to maintain the natural driving force of the well for a time to produce as much of the liquid production fluids as practicable. However, at a later time, it may be preferred to draw those gases from the well.

In such circumstances, the reversible particulate accumulation may be triggered to open the inner permeable region. The reversible particulate accumulation may be triggered by pumping a reversal fluid into the wellbore, which may be done through any suitable methods. Continuing with the exemplary scenario presented, the reversal fluid may dissolve or otherwise affect the smaller particles while leaving the larger particles in place. The dissolution of the smaller particles may open voids sufficiently large to allow the gaseous production fluids through the inner permeable region. In some implementations, the voids created may be sufficiently small to limit or significantly restrict the flow of liquids through inner permeable region. In other implementations of a reversible particulate accumulation, the particles may all be made of similar size and/or of the same material and the reversal fluid may dissolve or otherwise remove the accumulation in whole or in part. Accordingly, the selection of the particle sizes and materials may be informed at least by the conditions of the production interval and the conditions to be monitored for triggering the particulate accumulation and by the conditions that may motivate a reversal of the particulate accumulation.

While FIGS. 2A-2C provide a schematic illustration of a representative implementation of the present technology and a backdrop for discussion of several principles and features of the present disclosure and invention, FIGS. 3-13 provide illustrations of additional representation embodiments and implementations to further illustrate the scope of the present invention. While several examples are provided in the Figures, the scope of the present invention extends beyond the relatively limited number of implementations shown and includes all variations and equivalents of the illustrated embodiments and of the claims recited below.

Figure 4C:
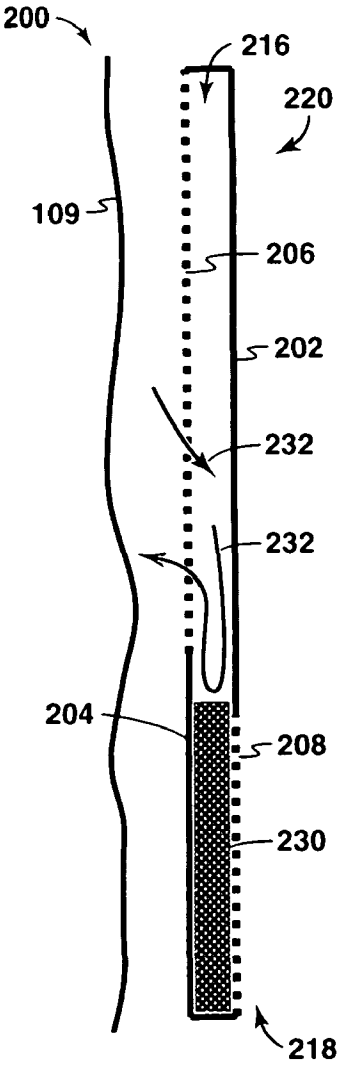
FIGS. 4A-4C are schematic views of a portion of a water control system.
Figure 4B:
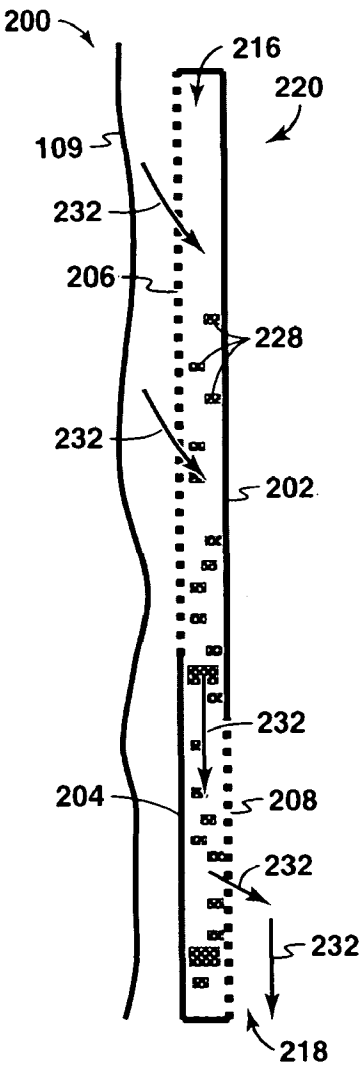
Figure 4A:
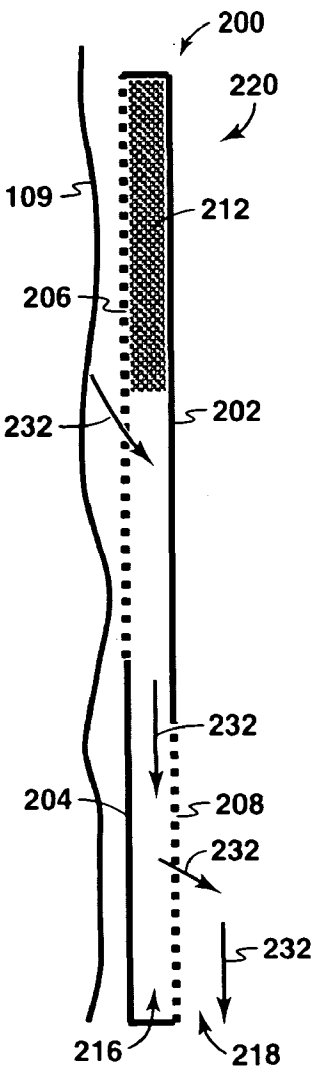
Figure 3:
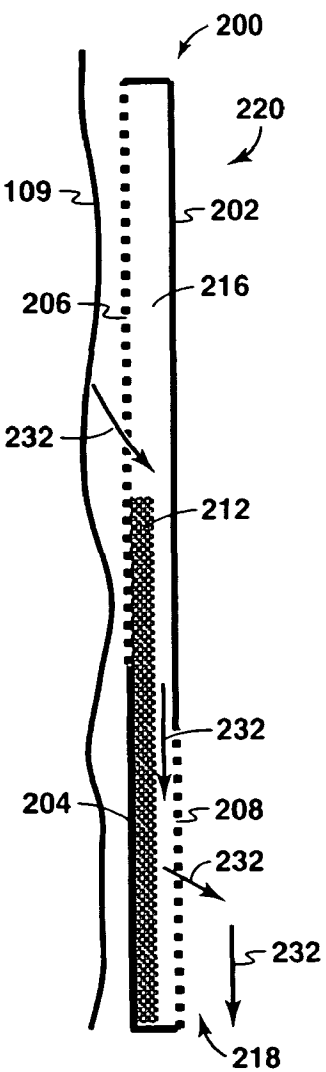
FIG. 3 is a schematic view of a portion of a water control system.

FIG. 3 and FIGS. 4A-4C provide similarly schematic representations of the present technology, including a consolidated particulate pack disposed in an external flow area. FIGS. 3 and 4A each represent an alternative initial configuration of a flow control chamber 220, where the illustrated difference is in the disposition of the particulate pack 212. Beginning with FIG. 3, a portion of a flow control system 200 is shown schematically disposed in a production interval containing production fluids 109. Similar to the illustration of FIGS. 2A-2C, the flow control system 200 includes a base pipe 202 having an inner permeable region 208 and includes an outer jacket 204 having an outer permeable region 206. The outer jacket 204 illustrated is representative of the various suitable outer jackets discussed above, such as an outer screen member, a length of production casing, etc. The space between the outer jacket 204 and the base pipe 202 defines an external flow area 216 within the flow control chamber 220. The production fluids 109 from the production interval pass through the outer permeable region 206 into the external flow area 216 and then pass through the inner permeable region 208 into the internal flow channel 218, as shown by flow arrows 232.

FIG. 3 illustrates the particulate pack 212 disposed within the external flow area 216 and near the inner permeable region 208 (as compared to the embodiment illustrated in FIG. 4A). The particulate pack 212 is disposed so as to be contacted by the production fluids 109 flowing through the external flow area 216. As illustrated, the production fluids 109 contact the particulate pack as the fluids flow around the edges of the pack 212. In some implementations, the particulate pack 212 may be porous or otherwise configured to allow production fluids 109 to flow through the pack or portions of the pack. As discussed above and better illustrated in FIGS. 4A to 4C, the particulate pack 212 is adapted to release the particles when contacted by triggering fluids and/or triggering conditions (such as time, concentration of particular chemicals or fluids, elapsed exposure time to particular conditions, etc.) and the inner permeable region 208 is adapted to retain at least some of the released particles to form a particulate accumulation blocking the inner permeable region.

FIGS. 4A to 4C illustrate yet another possible configuration of the particulate pack 212 within an external flow area 216. FIG. 4A illustrates all of the same components as FIG. 3 but disposes the particulate pack at the opposing end of the flow control chamber 220 from the inner permeable region 208. As flow control chambers 220 may be provided in any suitable length or configuration with the inner and outer permeable regions disposed in any suitable position relative to each other and to the overall length of the flow control chamber, the various views of FIGS. 2-4 illustrate merely exemplary configurations, which are not limiting to distances, shapes, or configurations of the particulate pack. With the particulate pack 212 disposed in the external flow area 216 and in a flow path defined therein for the production fluids 109 enroute to the internal flow channel 218, the particulate pack 212 is able to respond to the conditions of the production fluids and to close the flow control chamber as appropriate.

FIGS. 4B and 4C illustrate the effects of the triggering fluid on the particulate pack 212. FIG. 4B schematically represents the condition of the flow control chamber 220 after the production fluids 109 have exposed the particulate pack 212 to trigger fluids and/or triggering conditions for a sufficient amount of time to release all of the particles (released particles 228) that had been consolidated into the particulate pack. FIG. 4B illustrates all of the released particles 228 in motion at the same time (i.e., not yet forming a particulate accumulation 230). Such a state may exist in a flow control chamber 220 when the particulate pack 212 is configured with a binding agent selected to quickly release the particles once a triggering condition is encountered. Alternative binding agents and/or particulate pack configurations may have a slower release that retains at least some particles in the particulate pack 212 long enough that the released particles 228 begin to form a particulate accumulation 230 before the last particles are released.

FIG. 4C illustrates a flow control chamber 220 in a closed condition. More specifically, the released particles have formed a particulate accumulation 230 adjacent to the inner permeable region 208 to seal, or least substantially seal, the inner permeable region. As indicated by flow arrows 232, the flow of production fluids 109 into the flow control chamber 220 is blocked, or at least substantially blocked, by the particulate accumulation 230. The particulate accumulation 230 is illustrated schematically; it will be appreciated that actual particulate accumulations may not be formed with such precise and defined boundaries. Moreover, particulate accumulations 230 may be formed to completely fill the external flow area adjacent the inner permeable region 208 or the flow control system 200 may be configured to form a particulate plug that acts to block the fluid flow within the external flow area 216. The manner in which the released particles 228 accumulate in the external flow area 216 will be dependent upon a number of factors, including the size, shape, and density of the particles, the configuration and condition of the external flow area 216, and other properties of the wellbore and/or produced fluids, as described at least in part above and as illustrated in other Figures of the present disclosure.

Figure 5B:
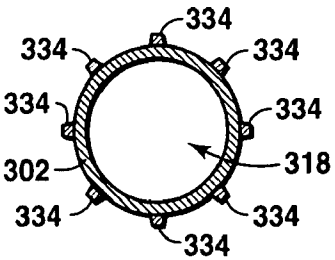
FIGS. 5A-5F illustrate various views and components of a water control system.
Figure 5D:
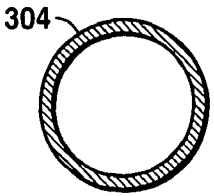
Figure 5A:
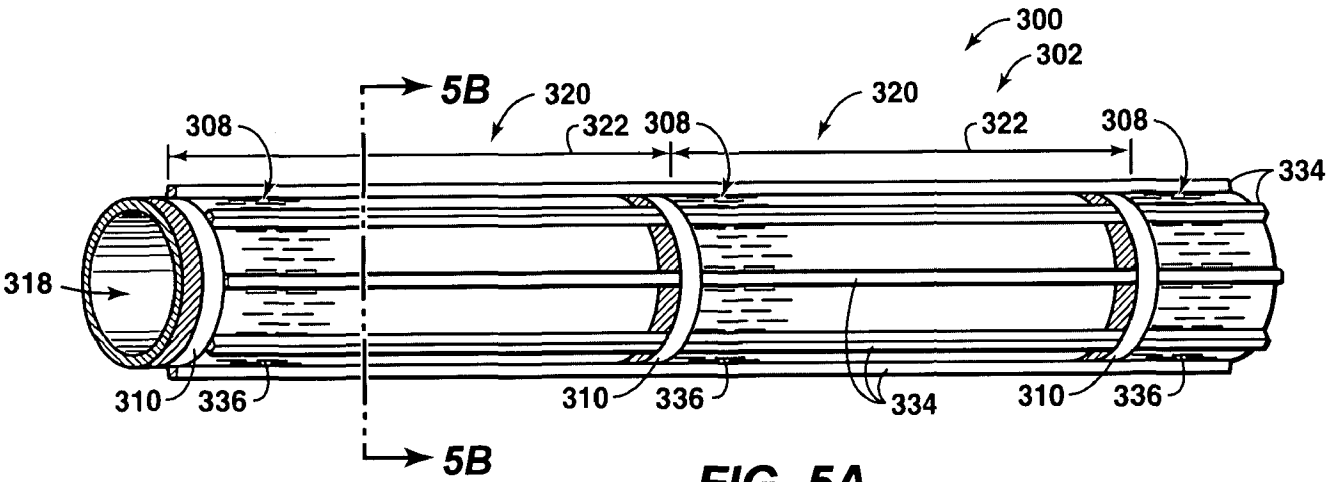
Figure 5C:
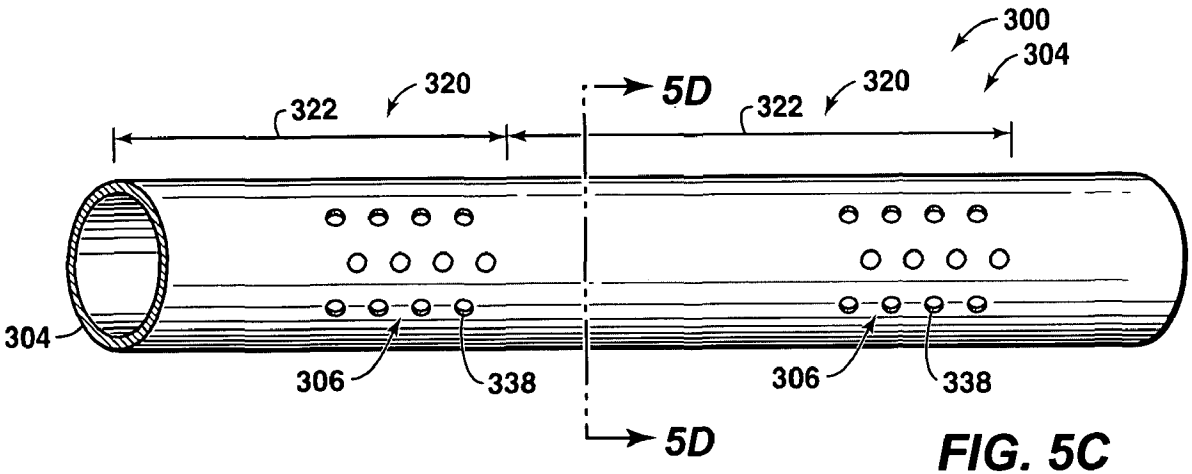
Figure 5E:
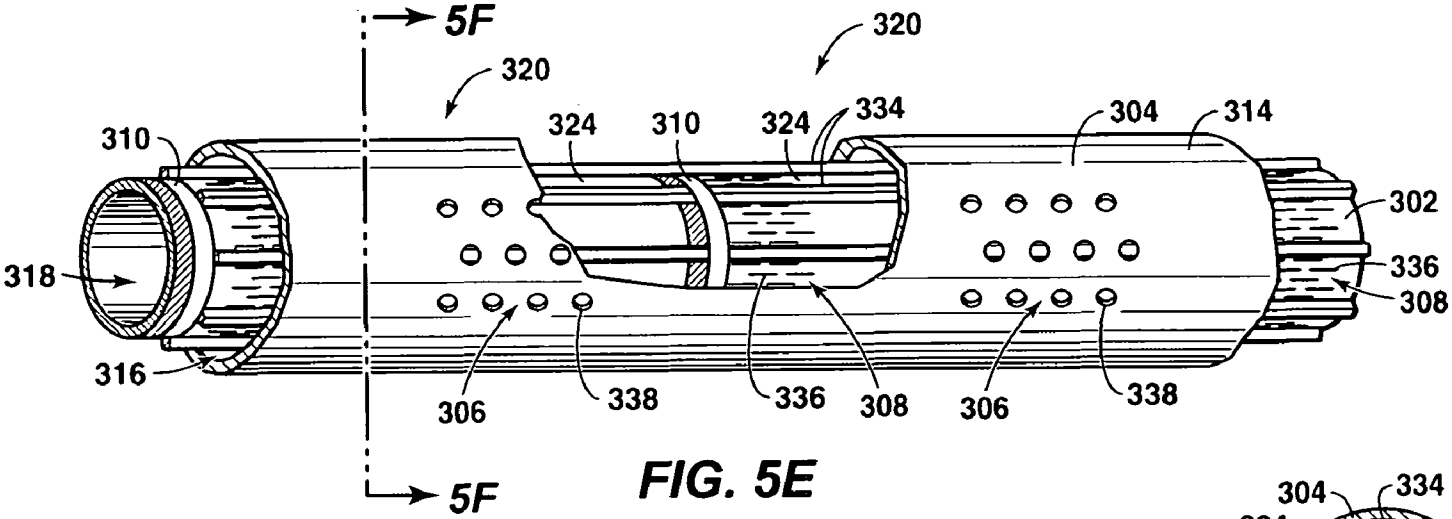
Figure 5F:
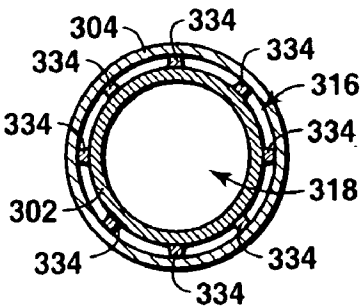

Turning now FIGS. 5A to 5F, various views of an exemplary flow control systems are illustrated. In the representative embodiment illustrated in FIGS. 5A-5F, the flow control system 300 is configured as a pair of concentric tubes designated as a first tubular member 302 and second tubular member 304, such as may be incorporated into a production tubing string. FIGS. 5A and 5B provide perspective and end views, respectively, of the first tubular member 302; FIGS. 5C and 5D provide perspective and end views, respectively, of the second tubular member 304; and FIGS. 5E and 5F provide perspective and end views, respectively, of the first and second tubular members assembled to provide a flow control system 300 including a plurality of flow control chambers 320.

FIGS. 5A and 5B illustrate an embodiment of the base pipe 302 and axial rods 334, which are illustrated as being coupled together. The base pipe 302, which may be referred to as an inner flow tube or a first tubular member, may be a section of pipe that has an internal flow channel 318 and one or more openings, such as slots 336, providing an inner permeable region 308. The axial rods 334, which may be disposed longitudinally or substantially longitudinally along the base pipe 302, can be coupled to the base pipe 302 via welds or other similar techniques. For instance, the rods 334 may attach to the base pipe 302 via welds and/or be secured by end caps with welds. Additionally or alternatively, the axial rods 334 may be held in place by the cooperation of the first tubular member 302 and the second tubular member 304 applying pressure on the axial rods. As further alternatives, the axial rods 334 may be coupled to the second tubular member 304 (FIGS. 5C and 5D) in any suitable manner. For example, the axial rods 334 may be welded to the second tubular member 304, which may be configured to press the axial rods against the first tubular member 302. Additionally or alternatively, the axial rods 334 may be disposed in recesses in the first and/or second tubular members to retain the axial rods in the proper orientation. The base pipe 302 and the axial rods 334 may include carbon steel or corrosion resistant alloy (CRA) depending on the level of corrosion resistance desired or needed for a specific application. The selection of materials may be similar to selection of materials for conventional screen applications. For an alternative perspective of the partial view of the base pipe 302 and axial rods 334, a cross sectional view of the various components along the line 5B is shown in FIG. 5B.

With continuing reference to FIG. 5A, the slots 336 are adapted to provide the inner permeable region 308 discussed above. Accordingly, the slots 336 may be adapted to prevent the passage of at least some of the particles released from the particulate pack used with the particular flow control system 300. For example, the width and/or length of the slots may be modified in light of the particle size distributions of the particulate pack.

FIG. 5A further illustrates that the slots 336 of the inner permeable region 308 are disposed adjacent to the chamber isolators 310. The chamber isolators 310 may be of the same or different materials as the base pipe 302 and/or the axial rods 334. The material selected for the chamber isolators 310 may be durable to withstand the conditions of the external flow area (e.g. abrasion, pressure, etc.). The chamber isolators 310 may be coupled to the base pipe 302 and/or the axial rods 334 by welding or other conventional techniques, which may include one or more of the techniques described above for the axial rods. Chamber isolators 310 may be disposed adjacent to each inner permeable region 308, as illustrated, or may be spaced away from the inner permeable region. Additionally or alternatively, flow control chambers 320, defined by the space between adjacent chamber isolators 310, may include more than one inner permeable region 308.

In some implementations, the released particles may need the assistance of a chamber isolator 310 to begin accumulating over an inner permeable region 308. In other implementations, the configuration of the external flow area 316 (see FIG. 5F) may be sufficient to cause the released particles to begin accumulating and to form a plug. For example, the length and cross-section areas of the external flow areas 316 (the areas between the axial rods 334) may be such that the released particles naturally accumulate and form a particulate plug in the external flow area. As an additional example, the external flow area may be an area between a base pipe and a casing string wherein gravel pack or fracture pack materials are disposed in the annulus. In such implementations, the gravel pack materials may cause the released particles to accumulate before reaching the inner permeable region 308 and a particulate plug may form away from the inner permeable region 308. Accordingly, while the configuration of the inner permeable region 308 may be dependent on the configuration of the particulate pack, it is not necessary in all implementations.

Continuing with the discussion of the slots 336 of FIG. 5A, the slots may additionally or alternatively be adapted to provide sand control to prevent or restrict the flow of formation particles, such as sand, from passing between the external region of the base pipe 302 and the internal flow channel 318. For instance, the slots 336 may be defined according to "Inflow Analysis and Optimization of Slotted Liners" and "Performance of Horizontal Wells Completed with Slotted Liners and Perforations." See T. M. V. Kaiser et al., "Inflow Analysis and Optimization of Slotted Liners," SPE 80145 (2002); and Yula Tang et al., "Performance of Horizontal Wells Completed with Slotted Liners and Perforations," SPE 65516 (2000). Additionally or alternatively, it is noted that the outer permeable region 306 may be adapted to provide some degree of sand control. It should also be noted that the inner permeable region 308 on the first tubular member 302 may be provided by configurations other than the slots 336. For example, mesh type screens, perforations, wire-wrapped screens, or combinations of these or other conventional methods of providing controlled or limited access to base pipes may be used.

FIGS. 5C and 5D illustrate a second tubular member 304 that may be disposed around the first tubular member 302 and axial rods 334 of FIGS. 5A and 5B. FIG. 5C provides a perspective view while FIG. 5D provides a cross-sectional view along line 5D. The second tubular member 304, may be a section of pipe with openings or perforations 338 along the length thereof. The second tubular member 304 may include carbon steel or CRA, as discussed above in connection with the first tubular member. Other suitable materials may be used depending on the expected conditions under which the flow control system will be used.

The perforations 338 are one example of a suitable method of forming an outer permeable region 306. The perforations 338 may be sized to minimize flow restrictions (i.e. sized to allow particles, such as sand to pass through the perforations 338) or may be sufficiently small to limit the flow of sand and/or other formation materials. The perforations may be shaped in the form of round holes, ovals, and/or slots, for example. While the outer permeable region 306 may be provided by perforations 338, the outer permeable region may be provided in any suitable manner, such as by slots, as described above, by wire-wrapped screen, by mesh screen, by sintered metal screen, or by other conventional methods, including conventional sand control methods. In some implementations, the openings of the outer permeable region 306, whether by perforations 338 or otherwise, can be sized to retain the released particles from the consolidated particulate packs of the present disclosure. Accordingly, the configuration of the outer permeable region 306 may be dependent upon the choice of materials for the particulate packs and vice versa.

Considering FIGS. 5A, 5C, and 5E, it can be seen that both the first tubular member 302 and the second tubular member 304 are configured with permeable regions and impermeable regions. More specifically, it can be seen in FIG. 5E that the first tubular member 302 is configured with an inner permeable region 308 and an inner impermeable region 324 and that the second tubular member is configured with an outer permeable region 306 and an outer impermeable region 314. FIG. 5E similar to the Figures described above, illustrate the inner and outer permeable regions 308, 306 in offset dispositions or configured such that the permeable regions do not overlap each other. While an offset configuration is suitable for flow control devices, such a configuration is not required for the successful implementation of the present invention, as will be seen through the schematic illustrations of FIGS. 9-14.

The use of permeable and impermeable regions in the first and second tubular members allows for the possibility of a changed-path flow chamber in the flow control system. The changed-path flow chamber effectively acts as a baffle or flow diversion means to redirect the flow from a radially incoming direction to a longitudinal direction and/or circumferential direction. While not required for the practice of the present invention, implementation of a configuration providing a changed-path flow chamber may provide additional features to the flow control systems of the present invention. For example, the flow redirection may reduce the energy in the incoming produced fluid, which may result in prolonging the usable life of the inner permeable region 308.

The usable life of the inner permeable region 308 may be prolonged by reducing the pressures and forces that tend to penetrate the screens or meshes of the inner permeable region. It is known that screens and meshes conventionally used in sand control devices have a tendency to tear or otherwise create openings defeating the purpose of the sand control device. These openings are caused, at least in part, by the forces applied on the screen by the particle-laden fluids flowing directly onto or through the screen. The risk of the screen yielding to these forces is particularly greater in localized "hot spots" (e.g., where production flows are concentrated due to plugging in surrounding areas). These localized hot spots may form due to a variety of circumstances within the wellbore, many of which are not controllable by the well operators. In some implementations, the changed-path flow control chamber may be configured to redistribute the energy of the incoming production fluids and to reduce the energy of the hot spots while slightly increasing the energy applied to the rest of the inner permeable region 308. The redistribution of the forces across the surface area of the inner permeable region 308 prolongs the life of the inner permeable region.

When a changed-path flow chamber is implemented, the outer permeable region may be configured in a variety of suitable manners. For example, it may be preferred to configure the outer permeable region to control the inflow of formation particles that may prematurely block the inner permeable region. Additionally or alternatively, it may be preferred to configure the outer permeable region to resistance tearing or opening under the pressures of the production fluid.

Once the production fluids pass through the outer permeable region 306, the production fluids are redirected and flow through the external flow area en route to the inner permeable region 308 where the fluids must again change directions to pass through the inner permeable region and into the internal flow channel 318. As the production fluids flow through the external flow area, the energy is redistributed across the flow profile and the risk of hot spots in the inner permeable region 308 is minimized. Depending on the configuration of the wellbore and the flow control system, this turn at the inner permeable region 308 may be a 180 degree turn, or a U-turn, to join the flow in the internal flow channel. The chamber isolators 310 may be configured to endure the forces that would be applied thereon in light of this fluid redirection at the inner permeable region 308. As can be seen, the fluid flow impacting the inner permeable region 308 has been baffled or redirected at least twice and its energy reduced and/or distributed accordingly. Without being bound by theory, it is believed that implementation of a changed-path flow chamber will result in an inner permeable region 308 having a longer life and/or an inner permeable region more capable of enduring a variety of wellbore conditions. Additionally or alternatively, the changed-path flow chamber may allow the inner permeable region 308 to be provided by a greater diversity of configurations and/or materials.

FIGS. 5E and 5F illustrate an embodiment with the second tubular member 304 disposed around the first tubular member 302 and axial rods 334. The second tubular member 304 can be secured to the first tubular member 302 via coupling to the axial rods 334. This coupling may be made by welds or other similar techniques, as noted above. As one example, the second tubular member 304 may be provided with one or more grooves or slots (not shown) in the interior surface adapted to receive one or more of the axial rods 334. The second tubular member 304 may then be slid onto the first tubular member 302 and the axial rods 334 with the relationship between the axial rods 334 and the grooves on the second tubular member maintaining the desired rotational orientation between the first and second tubular members. The assembly of the first tubular member 302, the second tubular member 304, and the axial rods 334 may then be coupled together by welding at the longitudinal ends 340 of a section of the flow control system 300. Additionally or alternatively, the sections of the flow control system may terminated by end caps (not shown), which may be welded or otherwise coupled to one or more of the first tubular member 302, the second tubular member 304, the axial rods 334, and the chamber isolator(s) 310. Alternatively, the axial rods 334 may be secured to the second tubular member 304 and the combination then slid onto the first tubular member 302, which assembly can be completed and coupled together in any suitable manner, such as using end caps.

FIG. 5F provides a cross-section view of the assembly illustrated in FIG. 5E, including the first tubular member 302, the second tubular member 304, and the axial rods 334. FIG. 5F further illustrates the internal flow channel 318 and the external flow area 316. It should be noted that FIGS. 5A-5F illustrate the use of eight axial rods 334 in particular rotational orientations around the first tubular member 302, but that such a configuration is merely exemplary of the suitable configurations for an external flow area 316 that can be implemented according to the present disclosure. The axial rods 334 may further define the external flow area by breaking the annulus into discrete flow channels, but the quantity and configurations of such discrete channels may be varied to meet the conditions in the wellbore and/or the configuration of the flow control system. For example, greater or fewer axial rods may be provided, including the possibility of using no axial rods at all. Moreover, the axial rods 334 can be circumferentially spaced evenly around the annulus or may be disposed in particular locations based on the conditions of the wellbore. For example, an angled or horizontal wellbore may suggest a configuration for the flow control system 300 different from a configuration that is best suited for a vertical wellbore. Alternatively, the axial rods may be provided in more complex patterns, such as non-linear or non parallel patterns.

Figure 6:
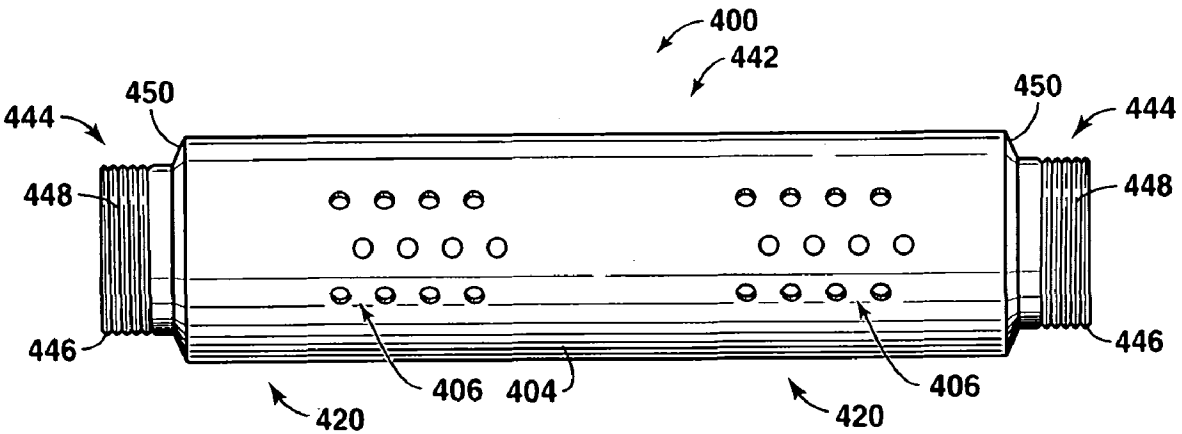
FIG. 6 is schematic side view of an assembled water control system.

FIG. 6 illustrates an embodiment of an assembled member 442 of a flow control system 400 with end caps 444 disposed around the first tubular member (not shown), the axial rods (not shown), and second tubular member 404. The end caps 444 illustrated are by way of example only as the end caps can be provided in any suitable configuration while staying within the scope of the present disclosure. The specifics of configuration for a particular flow control system 400 may vary for different wellbores and/or for different use conditions. For example, the end caps 444 may be adapted to facilitate the coupling together of adjacent members of the flow control system and/or may be adapted to facilitate the coupling of a flow control system member to other members of a production tube.

As illustrated in FIG. 6, each of the end caps 444 includes neck regions 446 that include threads 448 utilized to couple the member 442 of the flow control system with other members of the flow control system, sections of pipe, and/or other devices. The end caps 444 may be coupled to the second tubular member 404, the axial rods (not shown), and/or the first tubular member (not shown) at neck regions 446, such as in sections 450 where the neck region 446 is adapted to fit to the remaining components of the flow control system member 442. In the neck regions 446, the end caps 444, the second tubular member 404, the axial rods (not shown), and the base pipe (not shown) may be welded together in a manner similar to that performed on wire wrapped screens. The first tubular member (not shown) may extend beyond either end of the second tubular member 404 to provide room for tubing connections, for connecting members of flow control systems together, or for connecting other tools with the flow control system member 442.

FIG. 6 also illustrates features and principles related to the construction of a flow control system such as illustrated in FIG. 1. As illustrated in FIG. 1, the production string 100, and more particularly the tubing string 120, includes a plurality of flow control systems 200, with one system 200 disposed in association with each of the production intervals 108. The flow control systems 200 of FIG. 1 can be provided by a single member 442 of FIG. 6 or can be provided by a combination of two or more members 442. As one example when the use of multiple flow control system members 442 may be practical is when the particular production interval 108 is larger than would be practical to use a single member. As another example, it may be practical to utilize multiple members when a particular production interval 108 is believed to have different conditions that might justify different treatments. For example, one region of the interval may be more concerned with the control of water while another region may be more concerned with the production of hydrogen sulfides or other unwanted chemicals. In such circumstances, a first flow control member can be configured to respond to water as the triggering fluid while a second flow control member can be configured to respond to the other undesired condition.

FIG. 6 further illustrates that a single flow control member 442 may be configured to include more than one flow control chambers 420. As above, a flow control chamber 420 is the space between chamber isolators (not shown). The flow control chambers 420 in a single flow control member 442 may be similarly configured or may be configured differently. For example, the configuration of the permeable regions may vary between the chambers, the sensitivity and/or triggering fluids/conditions for the particulate pack may vary between chambers, or other of the parameters discussed herein may be varied to suit the conditions under which the flow control system 400, the particular flow control member 442, and/or the particular flow control chamber 420 will be used.

FIG. 7 is a schematic representation of a flow control system 500 disposed in a wellbore 114. The flow control system 500 may incorporate any one or more of the principles, features, and variations described above in addition to those described here in connection with the embodiment of FIG. 7. The wellbore 114 of FIG. 7 is a cased-hole well, which may be cased in accordance with any of the variety of conventional techniques. In FIG. 7, a section of the wellbore 114 is shown with flow control systems 500*a* and 500*b* disposed adjacent to production intervals 108*a* and 108*b*. In this section of the wellbore, packers 124*a*, 124*b*, and 124*c* are utilized with the flow control devices 500*a* and 500*b* to provide separate flow control chambers 520 associated with the separate production intervals 108*a* and 108*b*.

In the implementation of FIG. 7, the flow control system 500 is provided by a combination of the production tubing string 120 and the production casing string 118 providing the first tubular member 502 and the second tubular member 504, respectively. The interior 126 of the production tubing string 120 provides the internal flow channel 518 discussed above while the conventional annulus 128 between the production tubing string and the production casing string 118 provides the external flow area 516 discussed above. The packers 124 are positioned to serve as flow chamber isolators 510 defining sections of the wellbore as flow control chambers 520. The inner permeable region 508 is provided by the slots 536 on the production tubing string 120 and the outer permeable region 506 is provided by the perforations 130 through the production casing string 118 and the cement 132. A flow path 134 is defined between the perforations 130 in the casing string and the inner permeable region 508 that allows the produced fluids to enter the internal flow channel of the production tubing string.

The outer permeable region 506 provided by the perforations 130 illustrates the wide range of configurations available for the outer permeable region, which may include configurations having a natural or artificial filtration feature or no screen or filtering feature whatsoever. Moreover, it should be noted that the inner permeable region 508 may be provided by any suitable adaptation of a conventional production tubing string. For example, a conventional production tubing sleeve may be provided with an otherwise conventional sand control device that is further adapted for use with the particulate packs of the present disclosure, such as having openings sized to retain at least some of the released particles to cause a particulate accumulation to form.

As discussed above, the flow control systems of the present invention include a particulate pack 512 or other form consolidated particulate material disposed in an external flow area, which is at least partially defined by the outer surfaces of a first tubular member 502, which here is illustrated as the production tubing string 120. As illustrated in flow control chamber 520*b*, a schematically illustrated particulate pack 512 is disposed about the production tubing string 120 in a manner to be in the external flow area 516 (annulus 128) and in the flow path 134. With continuing reference to flow control chamber 520*b*, the fluids in flow path 134 pass over or through the particulate pack 512 to enter the production tubing string 120 via the inner permeable region 508. Because the particulate pack 512 is contacted by the fluids, the particulate pack is able to respond to changing conditions in flow control chamber 520*b* without intervention from a user.

Accordingly, should the conditions in the flow control chamber 520*b* change such that a triggering condition is satisfied, particles from the particulate pack 512 will be released, which may occur according to any one or more of the scenarios and implementations discussed herein. After the triggering condition is satisfied for a sufficient amount of time, some or all of the particles will have been released and will have formed a particulate accumulation 530, as illustrated in flow control chamber 520*a* of FIG. 7. The particulate accumulation may be of any suitable configuration to block, or at least substantially block, fluid flow through the inner permeable region 508 of the flow control chamber, here chamber 520*a*. With reference to flow control chamber 520*a*, it can be seen that fluids 552 entering flow control chamber 520*a* experienced a substantially blocked flow path 554 and at least a majority of the fluids are not allowed to enter the internal flow channel 518.

The representative implementation of a flow control system 500 shown in FIG. 7 further illustrates that the relative positions of the inner permeable regions 508 and the outer permeable regions 506 can vary depending on the configuration of the flow control system and/or the conditions under which it will be operated. In several of the preceding illustrations, the particulate packs (212 and 312) were disposed vertically above the inner permeable regions (208 and 308) and the fluid flows were illustrated as flowing downward, thereby benefiting by the force of gravity. In the implementation of FIG. 7, the inner permeable region 508 is disposed vertically above the outer permeable region 506 creating an upward directed flow path. The upward paths of the flow control system 500 of FIG. 7 require the released particles of the particulate pack 512 to flow against gravity to form the particulate accumulation 530 adjacent to the inner permeable region. Depending on the density of the particles used in the particulate packs and the density of the fluids entering the external flow area 516, such an upward configuration may present problems. However, some implementations of the present flow control systems may utilize particles that are adapted to be buoyant, such as having a low density or other configurations that promotes floating in a liquid environment. For example, some particles suitable for use in the present invention may include an outer shell and a hollow core reducing the mass while maximizing the volume. Such particles may be naturally occurring or may be custom-made for this use. Accordingly, an upwardly-oriented flow path may utilize buoyant forces and the force of the flowing fluids to overcome the effects of gravity during operation.

Figure 8:
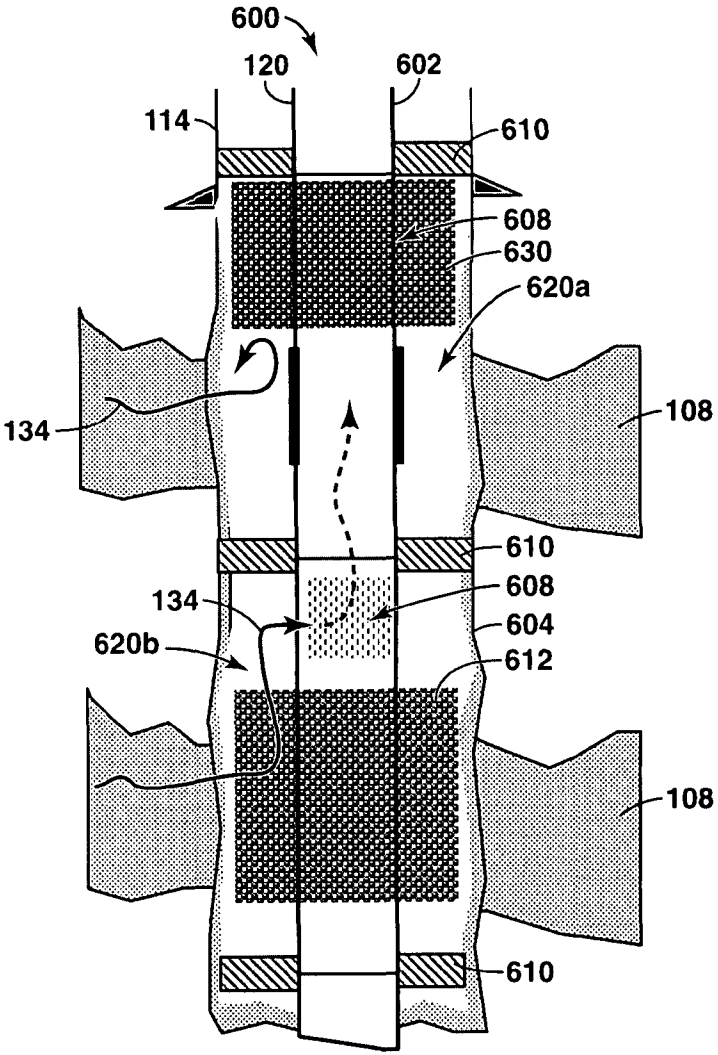
FIG. 8 is a schematic side view of water control systems disposed within a producing wellbore.

FIG. 8 is schematic illustration similar to that of FIG. 7, but showing the flow control systems 600 disposed in a wellbore 114 for an open-hole multi-zone well. In FIG. 8, however, the second tubular member 304 or outer jacket 204 discussed herein is provided by the natural walls 604 of the wellbore. The flow path 134 for fluids through the flow control systems 600 is from the wellbore wall into the flow control chambers 620 and contacting the particulate packs 612 before passing through the inner permeable region 608. The flow control chambers 620 are created within the annulus of the wellbore, as in FIG. 7, and may be formed with conventional packers, still-to-be-developed packers, other tools within the wellbore, and/or natural elements of the wellbore, such as the end or bottom of the wellbore, each of which may be referred to as chamber isolators when implementing the present invention. FIG. 8, similar to the Figures above, illustrates the inner permeable region 608 offset from the production intervals 108 of the formation, which would result in a changed-path flow chamber, however such a configuration is not required. The particulate pack 612 may be provided as an attachment to or as a part of the production tubing string 120, as illustrated, or may be coupled to or part of the packer or other device providing chamber isolators 610. The remainder of FIG. 8 is sufficiently similar to FIG. 7 that repetition of the descriptions thereof would be superfluous. It is sufficient to note that the particulate pack 612 (as seen in flow control chamber 620*b*) breaks down when exposed to a triggering condition and the particles from the particulate pack reform as a particulate accumulation 630 (as seen in flow control chamber 620*a*). Accordingly, the flow control systems 600, in a manner similar to the systems discussed above, provides a self-actuating flow control system that effectively blocks flow through a region or chamber of a production tube when an undesirable condition is found in that region of the wellbore, such as excessive water production.

FIGS. 9-13 provide additional schematic illustrations of flow control chambers 720 in a pre-trigger configuration, or before the particles of the particulate packs 712 have been released. For the purposes of FIGS. 9-13, at least in part because of the schematic nature thereof, the elements will be referenced by the same number across the Figures though the configurations of those elements vary as seen in the Figures. FIGS. 9-13 are provided to further illustrate the variety of configurations available within the scope of the present invention, including the variety of suitable relationships between the outer permeable regions 706, the inner permeable regions 708, and the particulate packs 712.

FIGS. 9-13 are schematically illustrated similar to FIGS. 3-4 above. FIG. 9 illustrates a flow control system 700 disposed adjacent to production fluids 109. The production fluids 109 enter an external flow area 716 through an outer permeable region 706. In the external flow area 716, the fluids pass by and contact a particulate pack 712. The fluids then enter an internal flow channel 718 through an inner permeable region 708. FIG. 9 illustrates at least some of the variations discussed above. For example, FIG. 9 illustrates that the particulate pack 712 may be coupled to the second tubular member 704. Moreover, FIG. 9 illustrates that the outer permeable region 706 may overlap, at least partially as shown here, the inner permeable region 708. At least one of the benefits of the offset permeable regions 706,708 was the resulting energy reduction in the fluids contacting the inner permeable region 708. As illustrated in FIG. 9, some of this energy reduction benefit may be provided by the disposition of the particulate pack 712 in the direct path from the outer permeable region 706 to the inner permeable region. Accordingly, fluids contacting the inner permeable region 708 have either changed course after passing through the outer permeable region 706 or have passed through the particulate pack 712, either of which will distribute the energy in the fluids and minimize the possibility for localized hot spots. However, as discussed above, the provision of offset permeable regions and/or flow damping effects by passing through the particulate pack 712 are not required in all implementations of the present invention. For example, the particulate pack 712 of FIG. 9 could be shortened at its illustrated bottom end exposing a direct path to the inner permeable region 708 without departing from the scope of the present invention.

Figure 10B:
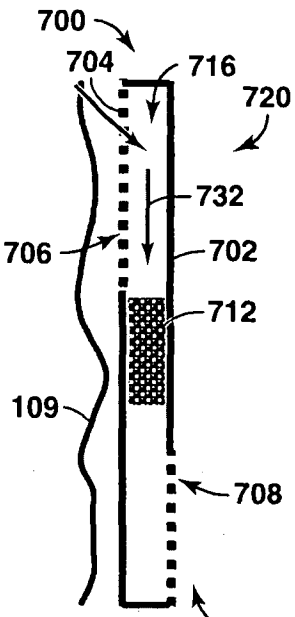
FIGS. 10A and 10B are schematic views of portions of water control systems.
Figure 10A:
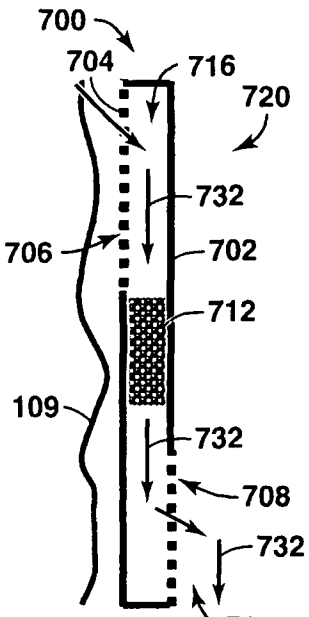

FIG. 10A is similarly schematically drawn to illustrate an alternative configuration of the particulate pack 712. The remainder of the elements of FIG. 10A is similar to those found in FIG. 9 and are not discussed at length here. However, it should be noted that the particulate pack 712 of FIG. 10A is not associated with the permeable regions of either the first or the second tunnel members, but is disposed in the flow path indicated by arrows 732 in the external flow area 716. It is also noted that the particulate pack 712 of FIG. 10A is disposed so as to eliminate any free pass or path way to the inner permeable region 708. The particulate pack 712 may be configured to be porous or to allow fluid to pass through the pack, such as by having pathways defined through the pack. Porous particulate packs disposed so as to fill the external flow area 716 may be configured in light of the pressure drop and flow resistance imposed by such a design. While the pressure drop caused by a flow-through particulate pack (as compared to a flow-by particulate pack) may be undesired, such a configuration may increase the quantity and/or quality of the contact between the fluids and the particulate pack 712. For example, if a rapid release of the particles is desired, the configuration of FIG. 10A may allow the triggering condition to be more quickly observed by a larger portion of the particulate pack 712, thereby releasing more particles in a shorter amount of time. A quick release of the particles may be desired when the triggering condition is particularly sensitive or significant to the operation of the well. Other wellbore conditions may favor a delayed release of the particles. It should also be noted that the particulate pack 712 of FIG. 10A may be coupled to the first tunnel member 702 and/or the second tunnel member 704.

FIG. 10B illustrates a variation on the configuration of FIG. 10A. As suggested by the lack of flow arrows 732 passing through the particulate pack 712, the particulate pack 712 of FIG. 10B fills the external flow area 716 and is not designed to allow fluid to pass therethrough. While some fluid may pass through the particulate pack, the pack 712 of FIG. 10B is not designed with pathways and is intended to block or at least substantially block the fluid flow into internal flow channel 718. Such a configuration may be desirable when the flow control chamber 720 is known to be disposed in a section of the interval that will produce undesired fluids initially followed by desired fluids. Accordingly, the plug particulate pack 712 of FIG. 10B may be configured to open pathways to the inner permeable region 708 when the desired fluids contact the particulate pack. For example, the plug particulate pack 712 may include materials that are soluble in the desired fluids such that pathways are formed in the particulate pack by the dissolution of the soluble materials. Additionally or alternatively, the binding materials of the plug particulate pack 712 may be adapted to release the particles when contacted by the desired fluids. In such a configuration, the released particles from the plug particulate pack 712 may be selected and sized to form a porous accumulation allowing fluid flow through the inner permeable region 708. FIG. 10B is in some respects the inverse of the configurations discussed in the remainder of this disclosure and is an example of the scope of the present invention. As discussed herein, the present invention is directed to a flow control system utilizing particulate materials that transition between at least two accumulated or packed configurations, one of which allows fluid flow into an internal flow channel and the other of which blocks fluid flow into the internal flow channel, which transition does not require user or operator intervention and occurs upon satisfaction of a triggering condition.

FIG. 11 illustrates yet another possible configuration of flow control systems within the scope of the present disclosure. The flow control system 700 of FIG. 11 includes a plurality of particulate packs 712 in the external flow area 716 spaced along the length of a single flow control channel 720. Each of the particulate packs 712*a*, 712*b*, 712*c* may be configured differently or may be of similar construction and composition. The illustrated positions of the particulate packs 712 are representative only and any distribution of particulate packs may be suitable for the present invention.

In some implementations of the present invention, a single flow control chamber may be configured to have a staged deployment of the flow control features. In the example of FIG. 11, the upper particulate pack 712*a* may be configured to respond more quickly to a given triggering condition releasing its particles before the other particulate packs begin to release particles. In such implementations, the particles of the upper particulate pack 712*a* may form a particulate accumulation at the location of the middle particulate pack 712*b*, effectively sealing off the upper portion of the flow control chamber 720 while allowing fluid to continue to enter internal flow channel through the remainder of the outer permeable region 706. In the illustrated example of FIG. 11, such a configuration may be desirable when an undesired fluid is known to be present above the location of the flow control chamber. When the undesired fluid first enters the production fluid and attempts to enter the internal flow channel, it will be coming from the upper end of the flow control chamber. Sealing just the upper portion may allow the lower portions of the flow control channel to continue producing desirable production fluids while the undesired fluid continues to work its way toward the remaining portions of the flow control chamber. In this respect, use of a multi-phase flow control chamber 720 may be similar to the use of a multiple flow control chambers in a string. It should be noted that the references to upper, lower, above, etc. are in relation to the implementation in the illustrated orientation and that corresponding references can be made for implementations having different orientations. For example, the permeable regions and particulate packs of FIG. 11 may be configured with staged deployment of particulate accumulations to at least substantially block undesired fluids from below the flow control chamber 720, such as when the staged deployment is implemented to control water production and the water is disposed below the hydrocarbons.

FIG. 12 presents yet another schematic illustration of a portion of a flow control system 700. In FIG. 12, the flow control system is disposed horizontally, such as may be the case in a horizontal wellbore. While the embodiment of FIG. 12 may be suitable for horizontally disposed flow control systems, horizontally disposed flow control systems of the present disclosure may include any of the features, elements, and configurations described herein and are not limited to the embodiment shown in FIG. 12. FIG. 12 further illustrates an embodiment wherein the inner and outer permeable regions 706,708 each extend the entire length of the flow control chamber 720 rather than including impermeable regions. The flow control chamber 720 of FIG. 12 is provided with a particulate pack 712 disposed closer to the inner permeable region 708, which may be coupled to the inner permeable region. The production fluids 109 flow along paths 732 through the outer permeable region 706 and into the external flow area 716, contacting the particulate pack 712 and entering the internal flow channel 718 through the inner permeable region 708. In some implementations, the particulate pack 712 is configured with pathways or other designs to be permeable during desired fluid production. In the event that a triggering condition exists in the flow control chamber, such as the presence of water, the particulate pack 712 releases some or all of its particles as described above to form a particulate accumulation adjacent to the inner permeable region closing the pathways in the particulate pack and blocking or at least substantially blocking the inner permeable region 708.

A variety of configurations may be implemented to ensure or at least promote the desired level of blockage in the flow control chamber, as has been discussed throughout. In the embodiment of FIG. 12 including a full length inner permeable region, the particulate pack 712 may be configured adjacent to the inner permeable region in a manner such that the released particles collapse towards the permeable region to form the accumulation. Stated otherwise, the particulate pack 712 may be configured to include particles spaced apart by a binding agent and may have pores or other passages defined through the particulate pack. As the binding agent contacts or is exposed to the triggering condition, the particles are released and collapse into the pores of the particulate pack and eventually collapse onto the inner permeable region 708. Other configurations may be implemented to encourage the released particles to accumulate in a desired manner to form a particulate accumulation that adequately blocks the inner permeable region. In this as well as the other embodiments described herein, it should be noted that the particles selected for the particulate pack and the quantity, size, shape, volume, and density thereof can be selected to form a particulate accumulation sufficient to block the desired portion of the inner permeable region, which may include the entirety of the inner permeable region. Similar to the discussion of FIGS. 10A and 10B, the configuration of FIG. 12 may be varied to provide initial blockage of the inner permeable region 708 that is opened upon satisfaction of a triggering condition, such as the commencement of production of a desired fluid.

Figure 13:
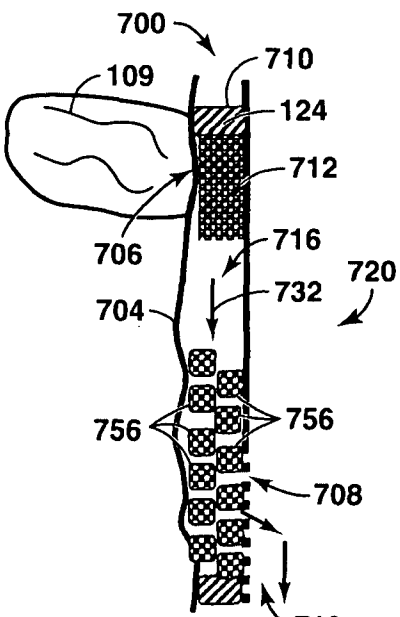
FIG. 13 is a schematic view of a portion of a water control system.

FIG. 13 schematically presents a variation on the embodiments shown in FIGS. 7 and 8 wherein the flow control systems are formed using parts of the wellbore and/or casing to form the outer jacket or second tubular member. FIG. 13 schematically illustrates the use of gravel pack or fracture pack techniques in the annulus between the wellbore wall and the production tubing string, such as including gravel 756. FIG. 13 illustrates the production fluids 109 within a production interval 108 adjacent to an open-hole wellbore. The wall of the open wellbore provides the outer jacket 704 of the present invention and the region of the wellbore wall adjacent to the production interval provides the effective outer permeable region 706 through which production fluids pass to reach the external flow area 716.

As can be seen in FIG. 13, the particulate pack 712 is disposed adjacent to the production interval such that the fluids entering the external flow area 716 come into contract with the particulate pack 712. As illustrated, the particulate pack 712 may be coupled to the production tubing and/or to the packer 124 serving as the flow chamber isolator 710. Acceptable configurations of the particulate pack will depend at least in part on the location of the production interval relative to the flow control chamber 720 defined by the packers 124. Once the particles are released from the particulate pack 712, the fluid flow path 732 carries the particles toward the gravel pack 756. In some implementations, the gravel pack 756 and released particles may be configured to allow the released particles through the gravel pack to form a particulate accumulation at the inner permeable region 708. Additionally or alternatively, at least some of the released particles may be retained by the gravel pack 756 and the particulate accumulation may be formed adjacent to the inner permeable region 708 but not directly contacting the permeable region. For example, the particulate accumulation may form at the top of the gravel pack 756 shown in FIG. 13, which would have substantially the same impact as a particulate accumulation formed at the inner permeable region 708.

Figure 14:
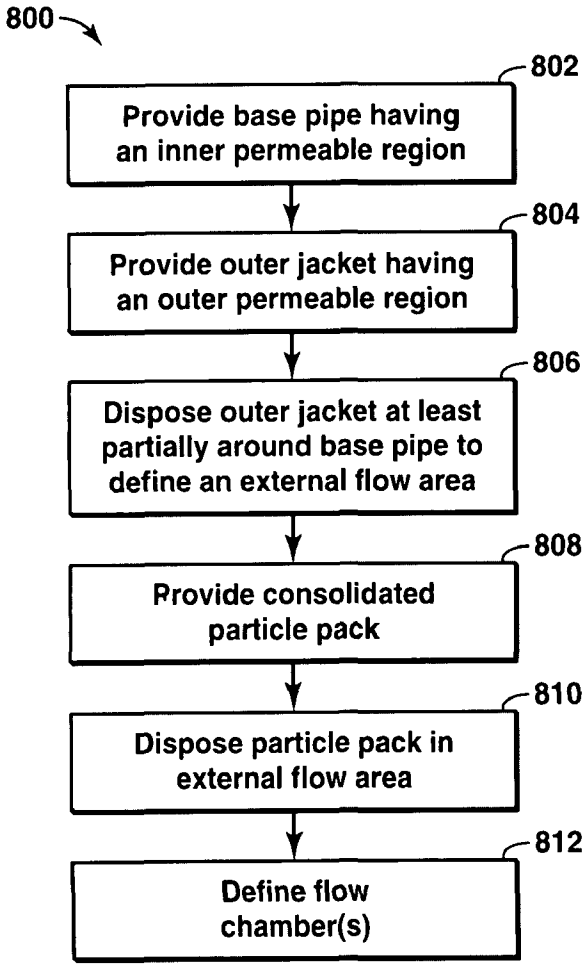
FIG. 14 is a flow chart representative of methods associated with the present disclosure.

Flow control systems within the scope of the present invention may include any of the variations and features discussed herein, which may include combining and/or rearranging features from one or more of FIGS. 1-13. As one example of a rearranging of the features illustrated above, packer technology, such as disclosed in connection with FIGS. 7 and 8, may be utilized in implementations where the packers are not serving as the chamber isolators. The packers would provide zonal isolation in addition to the local flow control provided by the flow control systems disclosed herein. FIG. 14 provides a relatively high level flow chart of at least some of the steps involved in implementing or developing flow control systems of the present invention. To the extent that the steps outlined in FIG. 14 utilize terminology more closely related to one or more of the embodiments described above, it should be noted that the method of FIG. 14 is merely representative of steps that may be taken according to the present invention as part of methods for forming or preparing flow control systems within the scope of the present invention.

In the exemplary method 800 of FIG. 14, the method commences with providing a base pipe 802 having an inlet to an internal flow channel. The inlet may be referred to as an inner permeable region. Additionally, an outer jacket is provided at 804. Similar to the base pipe, the outer jacket has an inlet, which may be referred to as an outer permeable region. The outer jacket referred to at step 804 may be any form or configuration of outer jacket, including those described herein, such as a second tubular member, a casing, or a wellbore wall. The outer jacket is then disposed at least partially around the base pipe at 806. The relationship between the outer jacket and the base pipe defines at least one external flow area. Accordingly, production fluids entering through the outer permeable region flow through the external flow area to the inner permeable region before passing into the internal flow channel.

The method of FIG. 14 continues with the provision of a consolidated particulate pack at 808, which is then disposed in the external flow area at 810. The consolidated particulate pack may be according to any of the various configurations described herein and variations and equivalents thereof. Additionally, the consolidated particulate pack may be disposed in the external flow area in any suitable manner that allows the particulate pack to be touched by the incoming production fluids en route to the inner permeable region. A flow control chamber is then defined at 812 to close portions of the external flow area and control the flow of fluids and particles released from the particulate pack.

The flow chart of FIG. 14 and/or the description herein of FIG. 14 include text or representations that imply a particular order to the steps or a timing of the steps. However, any one or more of the steps of FIG. 14 may be reordered and accomplished with greater or fewer steps without departing from the present methods. For example, the outer permeable region of the outer jacket may be created after the outer jacket is already disposed around the base pipe. Similarly, one or more elements that are used to define the flow control chamber may be associated with the base pipe and/or the outer jacket before the particulate pack is disposed in the external flow area. As one example, a first packer or chamber isolator may be installed between the base pipe and the outer jacket, particulate pack may then be disposed in the external flow area, and the second packer or chamber isolator may be installed. Other variations on the steps of FIG. 14 are within the scope of the present invention.

Figure 15:
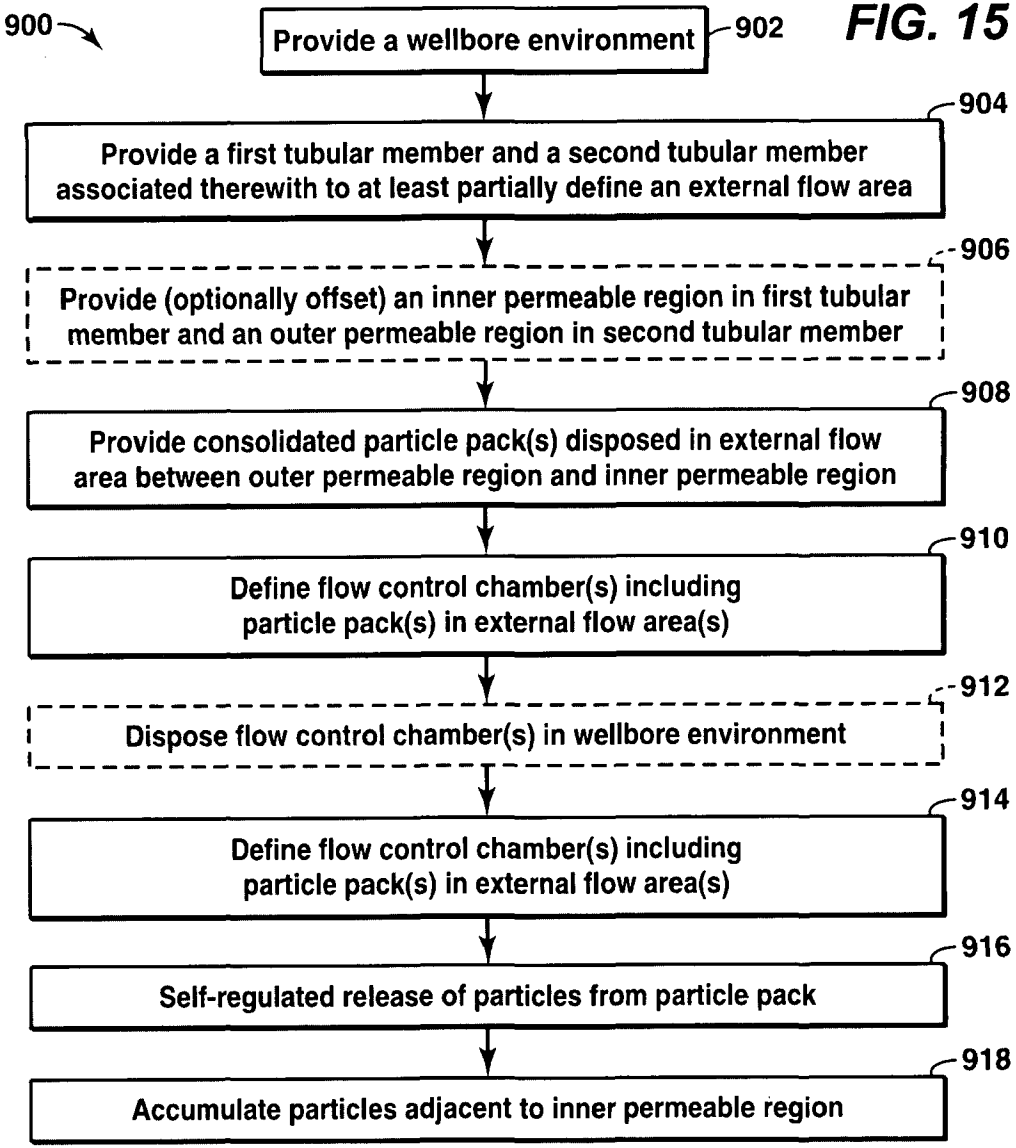
FIG. 15 is a flow chart representative of methods associated with the present disclosure.

FIG. 15 similarly provides a representative flow chart of steps that may be taken in methods of the present invention of utilizing flow control systems described herein. Similar to FIG. 14, the steps themselves and the order of the steps described in connection with FIG. 15 are representative only of some of the methods of the present invention. Variations in the steps and/or the order of the steps is within the scope of the present invention when such variations produce a flow control system utilizing a particulate material disposed in an external flow area that transitions from a first fixed condition to a free or released condition without requiring user or operator intervention when a triggering condition is satisfied, which released particles return to an accumulated, fixed condition, again without user or operator intervention, to control the flow of production fluids through a flow control chamber.

FIG. 15 illustrates methods 900 of operating flow control systems of the present invention to control flow through a portion of the flow control system. Accordingly, the operating methods 900 of FIG. 15 including providing a wellbore environment 902. The operating methods 900 may further include, at 904, providing a first tubular member and a second tubular member to define at least partially an external flow area. The second tubular member may be concentrically associated with the first tubular member such that the external flow area is an annulus between the first tubular member and the second tubular member. Additionally, the external flow area may be divided into smaller flow areas as appropriate.

Continuing with the methods of FIG. 15, the first tubular member is provided with an inner permeable region and the second tubular member is provided with an outer permeable region. The outer and inner permeable regions together with the external flow area may be configured to provide a flow path from a source of production fluids to an internal flow channel of the first tubular member. The provision of an inner permeable region and an outer permeable region is illustrated as 906 in FIG. 15, but it should be noted that the first and second tubular members may be provided with pre-formed permeable regions thereby rendering this step optional. Moreover, as indicated in FIG. 15, the relationship between the first and second tubular members and/or the inner and outer permeable regions may such that the permeable regions are offset from each other. In the event that the inner and outer permeable regions are offset, the flow path from the source of production fluids to the internal flow channel may be referred to as a changed flow path and the associated flow control chamber may be referred to as a changed-path flow control chamber.

Additionally, the methods 900 of FIG. 15 include providing a consolidated particulate pack and disposing the same in the external flow area, as indicated at 908. The consolidated particulate pack may be according to any of the descriptions provided herein and may be coupled to the first tubular member, the second tubular member, and/or another member of the flow control systems. It should also be noted that the consolidated particulate pack is disposed in the flow path prior to the production fluids passing through the inner permeable region to the internal flow channel. Typically, the particulate pack(s) will be disposed between the outer and the inner permeable regions. The manner in which the particulate pack(s) are disposed in the external flow area may be according to any of the configurations described herein or otherwise that places the particulate pack in a position to be exposed to the conditions to which the particulate pack is intended to respond.

At 910, it can be seen that the methods 900 of FIG. 15 include defining flow control chamber(s). The flow control chambers include at least one particulate pack and at least a portion of the external flow area. The materials or elements used to define the flow control chambers, as described above, may vary depending on the other design choices for the flow control system and/or the conditions of the wellbore. For example, the flow control chamber may be formed between two concentric pipes that are then disposed in the wellbore environment, such as shown at optional step 912. Alternatively, the flow control chamber may be formed by the relationship between a wellbore wall (cased or open), a base pipe disposed within the wellbore, and packers. As this alternative flow control chamber illustrates, the step 912 of disposing the flow control chamber in a wellbore environment is optional because it may have been accomplished as part of another step in the method 900, such as the step 904 of providing a first and second tubular member defining an external flow area.

Once the flow control chamber is defined and disposed in the wellbore environment, the methods allow produced fluids to enter the flow control chamber, at 914. The fluids may be allowed to enter the flow control chamber through any of the various methods used to initiate the flow of production fluids in a wellbore. As the production fluids enter the external flow area the fluids contact the particulate pack(s). In the event that the production fluids satisfy a triggering condition, such as the presence of water or the presence of water in too great a concentration, the particulate pack(s) are configured to release at least some of the particles into the flow within the external flow area, as indicated at 916. The release of particles is self-regulated and requires no user or operator intervention. The released particles and the inner permeable region are configured such that at least some of the released particles are retained in the external flow area and form, at 918, a particulate accumulation adjacent to the inner permeable region. The particulate accumulation then blocks at least a portion of the inner permeable region to control the flow of fluids satisfying a predetermined triggering condition.

As can be seen with reference to FIGS. 1-13 and the related description herein, the variety of configurations within the scope of the present invention are numerous but joined by common themes. Similarly, the methods of preparing, implementing, and using the systems of the present invention are diverse as are the conditions under which the present systems and methods may be used. Accordingly, the present flow control systems and methods may be used in a variety of production intervals or zones and under a variety of operating conditions. Beneficially, the various combinations of these flow control systems, such as those illustrated in FIGS. 2-13, may be utilized to control more than just the production of water or other undesirable fluid condition. For example, the implementation of the present invention to control the flow of water will have the beneficial effect of controlling the flow of sand that generally accompanies the flow of water.

Additionally or alternatively, the present systems and methods may provide an operator with the ability to block the flow of production fluids in one region of a wellbore while at the same time allowing other production intervals to continue to produce fluids unimpeded by sand and/or water production from the blocked production interval. Further, because this mechanism does not have any moving parts or components, it provides a low cost mechanism to shut off water production and/or other undesirable flow conditions for certain oil field applications.

The present techniques also encompass the placement of a composite particulate pack in a wellbore adjacent to a previously disposed basepipe. For example, some wells may already have a perforated basepipe disposed in them to allow production fluid coming into the well, but lack a reliable, self-regulated way to control the fluid through the perforated base pipe if the production fluid becomes undesirable in particular region of the well or interval of the formation. These wells may not have produced water (or other condition) at the time the basepipe was originally placed, but have begun to produce water or are likely to begin producing such byproducts. In a case such as this, an operator may run a smaller tubular member inside the base pipe (rendering the original base pipe an outer jacket according to the language of the present disclosure) and position a particulate pack in the newly formed annulus between the original base pipe and the new, smaller tubular member.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A system for use with production of hydrocarbons, the system comprising:

a first tubular member defining an internal flow channel and at least partially defining an external flow area, and wherein the first tubular member comprises a permeable region providing fluid communication between the external flow area and the internal flow channel; and a particulate composition disposed in the external flow area, wherein the particulate composition comprises a plurality of particles bound by a reactive binding material adapted to release particles in response to a triggering condition wherein the particulate composition is fixedly disposed in the external flow area until particles are released by the binding materials, and wherein particles released from the particulate composition move within the external flow area and are at least substantially retained in the external flow area to form a particulate accumulation at least substantially blocking the permeable region of the first tubular member.

2. The system of claim 1, wherein the particulate composition comprises a plurality of particles of varied dimensions.

3. The system of claim 1, wherein the binding material maintains its integrity when contacted by product fluids and releases particles when contacted by triggering fluids.

4. The system of claim 1, wherein the reactive binding material includes at least one composition selected from potassium silicate and urea; potassium silicate and formamide; and ethylpolysilicate, hydrochloric acid, and ethanol.

5. The system of claim 1, wherein the triggering condition includes the presence of one or more aqueous fluids.

6. The system of claim 1, further comprising at least one chamber isolator disposed in the external flow area adapted to at least partially block flow of particles in the external flow area to initiate particulate accumulation.

7. The system of claim 1, wherein at least two particulate compositions are disposed in the external flow area, and wherein the at least two particulate compositions are adapted to cooperatively provide staged deployment of the particles and staged blockage of the external flow area.

8. A system for use with production of hydrocarbons, the system comprising:

a first tubular member defining an internal flow channel, wherein the tubular member comprises a permeable region providing fluid communication with the internal flow channel;

an exterior member having an internal surface radially spaced from an outer surface of the first tubular member, wherein the first tubular member and the exterior member at least partially define an external flow area, wherein the exterior member comprises a permeable region, wherein the permeable region of the exterior member provides an inlet to the external flow area creating a flow path between the inlet of the exterior member and the permeable region of the first tubular member; and a particulate composition disposed in the external flow area at least partially in the flow path, wherein the particulate composition comprises a plurality of particles bound by a reactive binding material adapted to release particles in response to a triggering condition, and wherein at least some of the released particles accumulate to form a particulate accumulation at least substantially blocking the permeable region of the first tubular member.

9. The system of claim 8, wherein at least one of the permeable region of the first tubular member, the permeable region of the exterior member, and their combination is adapted to prevent formation particles from entering the internal flow channel.

10. The system of claim 8, wherein the particles of the particulate composition are selected from at least one of gravel, sand, carbonate, silt, clay, or man-made particles.

11. The system of claim 8, wherein the binding material maintains its integrity when contacted by product fluids and releases particles when contacted by triggering fluids.

12. The system of claim 8, wherein the reactive binding material is selected to control the rate of particle release from the particulate composition.

13. The system of claim 8, wherein the released particles are adapted to flow within the external flow area toward the permeable region of the first tubular member and are dimensioned to be at least substantially retained in the external flow area by the permeable region of the first tubular member forming the particulate accumulation at least substantially blocking the permeable region of the first tubular member.

14. The system of claim 8, wherein the particulate composition comprises particles having a variety of dimensions.

15. The system of claim 14, wherein the particles of the particulate composition have dimensions ranging from at least about 0.0001 mm to less than about 100 mm.

16. The system of claim 14, wherein the permeable region of the first tubular member has a predetermined opening size, and wherein greater than about 10% of the particles of the particulate composition are larger than the predetermined opening size of the first tubular member.

17. The system of claim 8, wherein the particles of the particulate composition comprise materials selected to provide a reversible particulate accumulation.

18. The system of claim 8, further comprising at least one chamber isolator disposed in the external flow area adapted to at least partially block flow of particles in the external flow area to initiate particulate accumulation.

19. A system for use in production of hydrocarbons, the system comprising:

a production string including a base pipe having an internal flow channel adapted to receive fluids when in a wellbore environment in a formation;

at least one changed-path flow chamber defined in the production string and associated with the base pipe, wherein each changed-path flow chamber comprises offset inner and outer permeable regions configured to define a flow path between the outer permeable region and the inner permeable region, wherein the inner permeable region provides fluid communication between the changed-path flow chamber and the internal flow channel, and wherein the outer permeable region provides fluid communication between the wellbore environment and the changed-path flow chamber;

a consolidated particulate pack disposed at least partially in the flow path between the inner and the outer permeable regions; wherein the consolidated particulate pack comprises a plurality of particles consolidated together by a binding agent selected to release particles in response to a triggering condition; and wherein the particles released from the consolidated particulate pack are dimensioned to be at least substantially retained by the inner permeable region such that the particles accumulate adjacent to the inner permeable region to at least substantially block the inner permeable region limiting the fluid communication between the changed-path flow chamber and the internal flow channel.

20. The system of claim 19, wherein the particles of the consolidated particulate pack are selected from at least one of gravel, sand, carbonate, silt, clay, or man-made particles.

21. The system of claim 19, wherein the binding agent maintains its integrity when contacted by product fluids and releases particles when contacted by triggering fluids.

22. The system of claim 19, wherein the binding agent is selected to control the rate of particle release from the consolidated particulate pack.

23. The system of claim 19, wherein the inner permeable region has a predetermined opening size, and wherein greater than about 10% of the particles of the particulate pack are larger than the predetermined opening size of the inner permeable region.

24. A method associated with the production of hydrocarbons, the method comprising:

providing a production/injection string including a base pipe having an internal flow channel adapted to receive fluids when in a wellbore environment in a formation;

defining at least one external flow area separated from the internal flow channel by an inner permeable region;

providing a consolidated particulate pack comprising a plurality of particles consolidated together by a binding agent selected to release particles in response to a triggering condition, wherein the released particles of the consolidated particulate pack are dimensioned to accumulate in the external flow area and to at least substantially block fluids from entering the internal flow channel; and fixedly disposing the consolidated particulate pack in the external flow area until the particles are released by the binding materials.

25. The method of claim 24, wherein defining at least one external flow area includes providing an outer jacket spaced away from the base pipe of the production/injection string and includes defining at least one flow control chamber including at least one inlet to the external flow area.

26. The method of claim 25, wherein the inlet to the external flow area is offset from the inner permeable region of the base pipe.

27. The method of claim 24 further comprising:

disposing the production/injection string in a well; and operating the well in association with the production of hydrocarbons, wherein the production string operates in a first configuration until the triggering condition is satisfied and the particles are released, and wherein the production string operates in a second configuration following the accumulation of the released particles.

28. The method of claim 27, wherein the well is operated as a production well.

29. The method of claim 27, further comprising reversing the particulate accumulation blockage in the external flow area.

30. The method of claim 27 further comprising producing hydrocarbons from the well.

* * * * *